US008068758B2

(12) United States Patent
Kaji

(10) Patent No.: US 8,068,758 B2
(45) Date of Patent: Nov. 29, 2011

(54) BELT CONVEYANCE APPARATUS AND IMAGE HEATING APPARATUS

(75) Inventor: Keigo Kaji, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 336 days.

(21) Appl. No.: 12/470,763

(22) Filed: May 22, 2009

(65) Prior Publication Data

US 2009/0297204 A1 Dec. 3, 2009

(30) Foreign Application Priority Data

May 27, 2008 (JP) ..... 2008-137657

(51) Int. Cl.
*G03G 15/20* (2006.01)
*G03G 21/20* (2006.01)
*G03G 15/16* (2006.01)

(52) U.S. Cl. ..... 399/69; 399/33; 399/92; 399/94; 399/122

(58) Field of Classification Search ..... 399/33, 399/67, 69, 70, 92, 94, 122
See application file for complete search history.

(56) References Cited

U.S. PATENT DOCUMENTS

| | | | | |
|---|---|---|---|---|
| 7,457,576 | B2 | 11/2008 | Takada et al. | 399/329 |
| 2001/0048822 | A1* | 12/2001 | Hanyu et al. | 399/67 |
| 2003/0198481 | A1* | 10/2003 | Kikuchi et al. | 399/69 |
| 2008/0008488 | A1* | 1/2008 | Kaji et al. | 399/67 |

FOREIGN PATENT DOCUMENTS

| | | |
|---|---|---|
| JP | 2001-183929 | 7/2001 |
| JP | 2002-287564 | 10/2002 |

* cited by examiner

*Primary Examiner* — David Gray
*Assistant Examiner* — Joseph Wong
(74) *Attorney, Agent, or Firm* — Fitzpatrick, Cella, Harper & Scinto

(57) ABSTRACT

The image heating apparatus has a plurality of heat generators which are capable of forming a plurality of heat generating distributions in the longitudinal direction for supplying heat to a heating member. Unevenness in temperature is decreased by changing the heat generating distribution when cooling by a fan for the heating member starts. The heat generating distribution is changed so that heat generating amount at an area in the longitudinal direction corresponding to the cooling area cooled by the fan is to be larger than the heat generating amount before starting the cooling.

4 Claims, 23 Drawing Sheets

AIR BLOWING COOLING MECHANISM PORTION

BELT CONVEYANCE APPARATUS AND IMAGE HEATING APPARATUS

BACKGROUND OF THE INVENTION

1. Field of the Invention

The present invention relates to an image heating apparatus for heating an image on a recording material which is utilized for an image forming apparatus which adopts an electrophotographic system, an electrostatic recording system or the like, such as copying machines, printers and facsimiles.

2. Description of the Related Art

A heat fixing method which heats and melts an unfixed toner image and fixes the unfixed toner image on a recording material has been commonly employed as a fixing method for the image forming apparatus from the viewpoints of safety and fixing performance.

With the fixing apparatus of the above heat fixing method, there is a problem that the temperature at a non-sheet passing portion rises when recording materials whose width is smaller (hereinafter, called small size sheets) than recording materials of the maximum sheet passing width (hereinafter, called maximum size sheets) are continuously passing.

In a case that recording materials of various sizes (widths) pass through a fixing area, a part of the fixing area through which the recording material passes is denoted as a sheet passing area, and the rest of the fixing area other than the sheet passing area is denoted as a non-sheet passing area. Further, a surface part of a heating member, such as a fixing roller surface, a fixing film surface and a pressure roller surface, which passes through the sheet passing area during rotation, is denoted as a sheet passing area passage surface. And, a surface part of the heating member which passes through the non-sheet passing area during rotation is denoted as a non-sheet passing area passage surface.

In the case that the maximum sheets are passing and fixing is performed, the temperature distribution of the heating member surface becomes approximately even along the entire fixing area. On the contrary, in the case that the small size sheets are continuously passing and fixing is performed, the temperature of the non-sheet passing area passage surface of the heating roller rises excessively. This is because heat is partly accumulated at the non-sheet passing area by the amount of heat which is not discharged to the sheets when the small size sheets are continuously passed.

In general, the non-sheet passing portion temperature rise becomes large under the condition that heat discharge to the sheets increases. For example, the condition includes the case that the sheet count of the fixing per unit time (namely, productivity) is large and the case that the weight of the recording material per unit area is large.

When the non-sheet passing portion temperature rise occurs due to continuous passing of the small size sheets, the temperature of the heating member exceeds the allowable range for usage. Consequently, the lifetime of the heating member is shortened.

Accordingly, a fan is disposed for blowing air to the heating member in Japanese Patent Application Laid-Open No. 2002-287564. Further, in Japanese Patent Application Laid-Open No. 2001-183929, a plurality of heaters whose heat generating amounts in the longitudinal direction differ from each other are disposed and the powering ratio of the heaters is changed in accordance with the size of the recording material.

With the configuration using a fan, there is a problem of noise caused by the rotation of the fan. With the method for changing the powering ratio, it is difficult to suppress a temperature rise at the non-sheet passing portion when a plurality of the recording materials are continuously heated.

As a countermeasure for addressing the problems of the two methods, it is considered that only the method for changing the powering ratio is adopted at the beginning and the air blowing is started after the temperature at the non-sheet passing portion becomes high when a plurality of the recording materials are continuously heated. However, in this case, the temperature at the boundary between the sheet passing portion and the non-sheet passing portion becomes low after air blowing and poor heating occurs.

SUMMARY OF THE INVENTION

The present invention provides an image heating apparatus which can maintain a heating member at an appropriate temperature even when the small size sheets are continuously passing with the above two methods being adopted in order to suppress a temperature rise at the non-sheet passing portion (end part) of the heating member.

The present invention also provides an image heating apparatus including a heating member which heats a toner image on a recording material at a nip portion, a first heater and a second heater which heat the heating member so that the heat generating amount of the first heater being larger at the center part in the longitudinal direction than at the end part, and the heat generating amount of the second heater is larger at the end part in the longitudinal direction than at the center part, changing means which changes the ratio of power supplied to the second heater to the power supplied to the first heater in accordance with length in the longitudinal direction of the recording material which is heated by the heating member, temperature detecting means which detects the temperature at the end part of the heating member, and a fan which performs air blowing to cool the end part of the heating member in accordance with the temperature detected by the temperature detecting means. Here, the changing means changes the time when the fan starts air blowing.

Further features of the present invention will become apparent from the following description of exemplary embodiments (with reference to the attached drawings).

DESCRIPTION OF THE EMBODIMENTS

Next, an image heating apparatus according to an embodiment of the present invention is described with reference to the drawings.

[First Embodiment]

Figure 2:
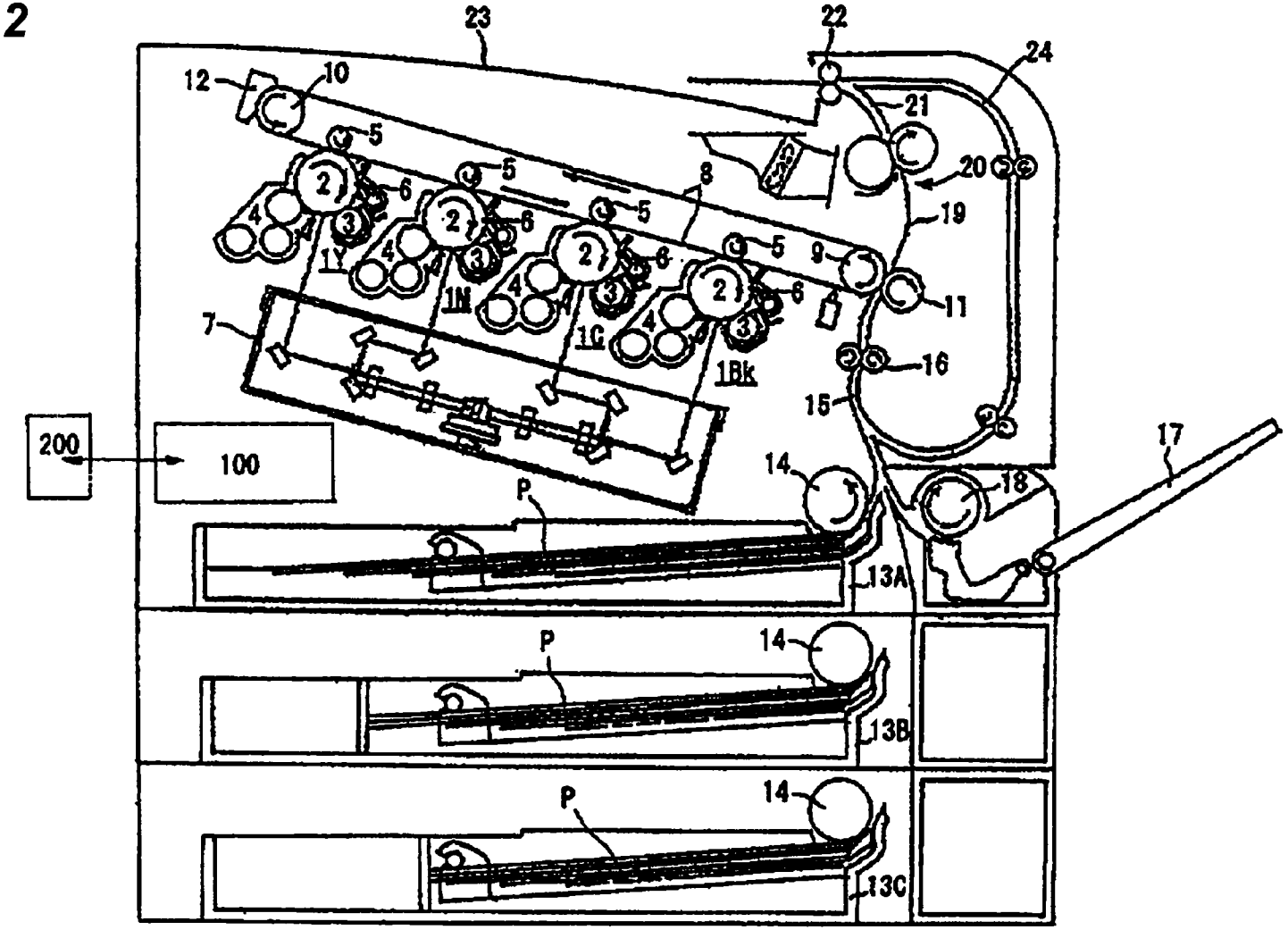
FIG. 2 is a vertical sectional view which schematically illustrates an example of an image forming apparatus in which the fixing apparatus is mounted.

FIG. 2 is a vertical sectional view which schematically illustrates the general configuration of an electrophotographic full-color printer as an example of an image forming apparatus in which the image heating apparatus according to the first embodiment is mounted as a fixing apparatus. First, an image forming portion is briefly described.

Image Forming Portion

The printer is capable of forming and outputting an image in full color on a recording material after performing an operation to form the image in accordance with input image information from an external host device 200 which is connected to communicate with a control circuit portion (control means) 100 of the printer.

The external host device 200 is a computer, an image reader and the like. The control circuit portion 100 exchanges signals with the external host device 200. The control circuit portion 100 also exchanges signals with various image forming devices and performs the sequential control of the image forming.

A belt 8 is a flexible intermediate transfer belt (hereinafter, abbreviated as a belt) shaped without an end and stretched between a secondary transfer counter roller 9 and a tension roller 10. When the secondary transfer counter roller 9 is driven, the belt 8 is driven to rotate at a predetermined speed in the counterclockwise direction as indicated by an arrow. Further, a secondary transfer roller 11 is arranged to press the secondary transfer counter roller 9 via the belt 8. The pressed portion between the belt 8 and the secondary transfer roller 11 is a secondary transfer portion.

Four image forming portions 1Y, 1M, 1C, 1Bk of the first through the fourth image forming portions are arranged in a line at predetermined intervals along the belt movement direction at the lower side of the belt 8. Each of the image forming portions is an electrophotographic process mechanism of a laser exposure system and respectively has a drum-shaped electrophotographic sensitizing member (hereinafter, abbreviated as a drum) 2 as an image bearing member which is driven to rotate at a predetermined speed in the clockwise direction as indicated by an arrow. A primary charger 3, a developing device 4, a transfer roller 5 as transfer means, and a drum cleaning device 6 are arranged around each of the drums 2. Each of the transfer rollers 5 is arranged inside the belt 8 and pressed to the corresponding drum 2 via a descending part of the belt 8. The pressed portions between each of the drums 2 and the belt 8 are the primary transfer portions. A laser exposure device 7 for the drums 2 of the image forming portions includes laser irradiating means which performs irradiation corresponding to a time sequential electro-digital pixel signal of given image information, a polygon mirror and a reflection mirror.

The control circuit portion 100 drives each of the image forming portions to form an image based on a color separation image signal which is input from the external host device 200. Accordingly, color toner images of yellow, magenta, cyan and black are formed at the image forming portions 1Y, 1M, 1C 1Bk of the first through the fourth image forming portions on the surfaces of the respectively rotating drums 2 at a predetermined control timing. Here, since the principle and the process of the electrophotographic image forming for forming the toner image on the drums 2 are well-known, the description thereof is omitted.

The above toner images which are formed on the surfaces of the drums 2 of the image forming portions are sequentially superimposed and transferred at the respective primary transfer portions to the outer surface of the belt 8, which is driven to rotate in the direction that is same as the rotation direction of the drums 2 at a speed corresponding to the rotation speed of the drums 2. In this manner, an unfixed full-color toner image is formed on the belt 8 by superposing the above four toner images.

On the other hand, a feeding roller 14 of a layer, selected from vertically multi-layered sheet cassette portions 13A, 13B and 13C, in which a variety of width sizes of recording materials P are stacked and accommodated respectively, is driven at a predetermined feeding timing. With this configuration, one sheet of the recording materials P which are stacked and accommodated in the sheet cassette at the layer is separated and fed, and then, conveyed to a registration roller 16 via a vertical conveying path 15. When manual feeding is selected, a feeding roller 18 is driven. With this configuration, one sheet of the recording materials which are stacked on a manual feeding tray (multi-purpose tray) 17 is separated and fed, and then, conveyed to the registration roller 16 via the vertical conveying path 15.

The registration roller 16 timely conveys the recording material P so that the top end of the recording material P arrives at the secondary transfer portion to match the timing at which the top end of the full-color toner image on the rotating belt 8 arrives at the secondary transfer portion. Accordingly, the full-color toner image on the belt 8 is thoroughly transferred secondarily on the surface of the recording material P at the secondary transfer portion. The recording material leaving from the secondary transfer portion is separated from the surface of the belt 8 and introduced to a fixing device (fixing implement) 20 while being guided by a vertical guide 19. The above toner image in plural colors is melted and mixed by the fixing device 20 so as to be fixed on the surface of the recording material as a permanently fixed image. The recording material leaving from the fixing device 20 is discharged on a discharge tray 23 via a conveying path 21 by a discharge roller 22 as a full-color image formed sheet.

After the recording material is separated at the secondary transfer portion, the surface of the belt 8 is cleaned by a belt cleaning device 12 so as to remove a remaining deposit, such as remaining toner, after the secondary transfer. Then, the belt 8 is repeatedly used for image forming.

In the case that a monochrome print mode is selected, only the fourth image forming portion 1Bk which forms a black toner image is controlled to perform the image forming operation. In the case that a two-sided print mode is selected, a recording material whose first face has undergone printing is to be discharged on the discharge tray 23 by the discharging roller 22 and the rotation of the discharging roller 22 is reversed just before the rear end of the recording material passes through the discharging roller 22. Accordingly, the recording material is introduced to a re-conveying path 24 by being switched back. Then, the recording material is conveyed to the registration roller 16 once more in the state that its faces are reversed. Subsequent to the above, being same as the first face printing, the recording material is conveyed to the secondary transfer portion and the fixing device 20 and is discharged on the discharge tray 23 as a two-side image formed sheet.

[Fixing Device]

Next, the fixing device 20 as the image heating apparatus according to the present embodiment is described. In the following description, the longitudinal direction of the fixing device and structural members thereof is the direction parallel to the direction perpendicular to the recording material conveying direction on a recording material conveyance passage surface. Regarding the fixing device, the front face is the face at the recording material introducing side. The left and right sides are the left side and right side of the device when viewed from the front face. The width of the recording material is the dimension of the recording material surface in the direction perpendicular to the recording material conveying direction.

Figure 1:
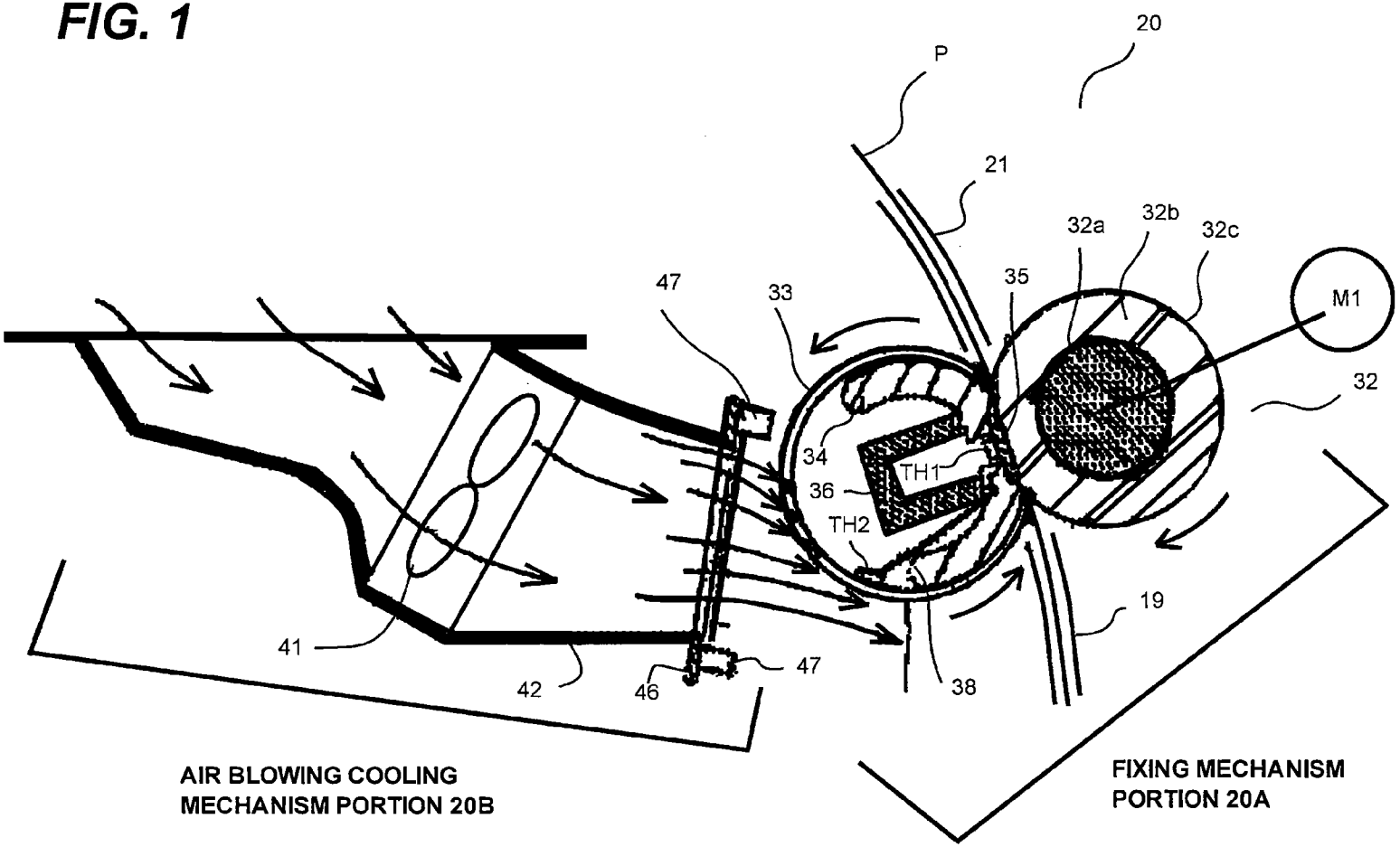
FIG. 1 is a side sectional view which schematically illustrates the general configuration of a fixing apparatus (image heating apparatus) of embodiments.
Figure 3:
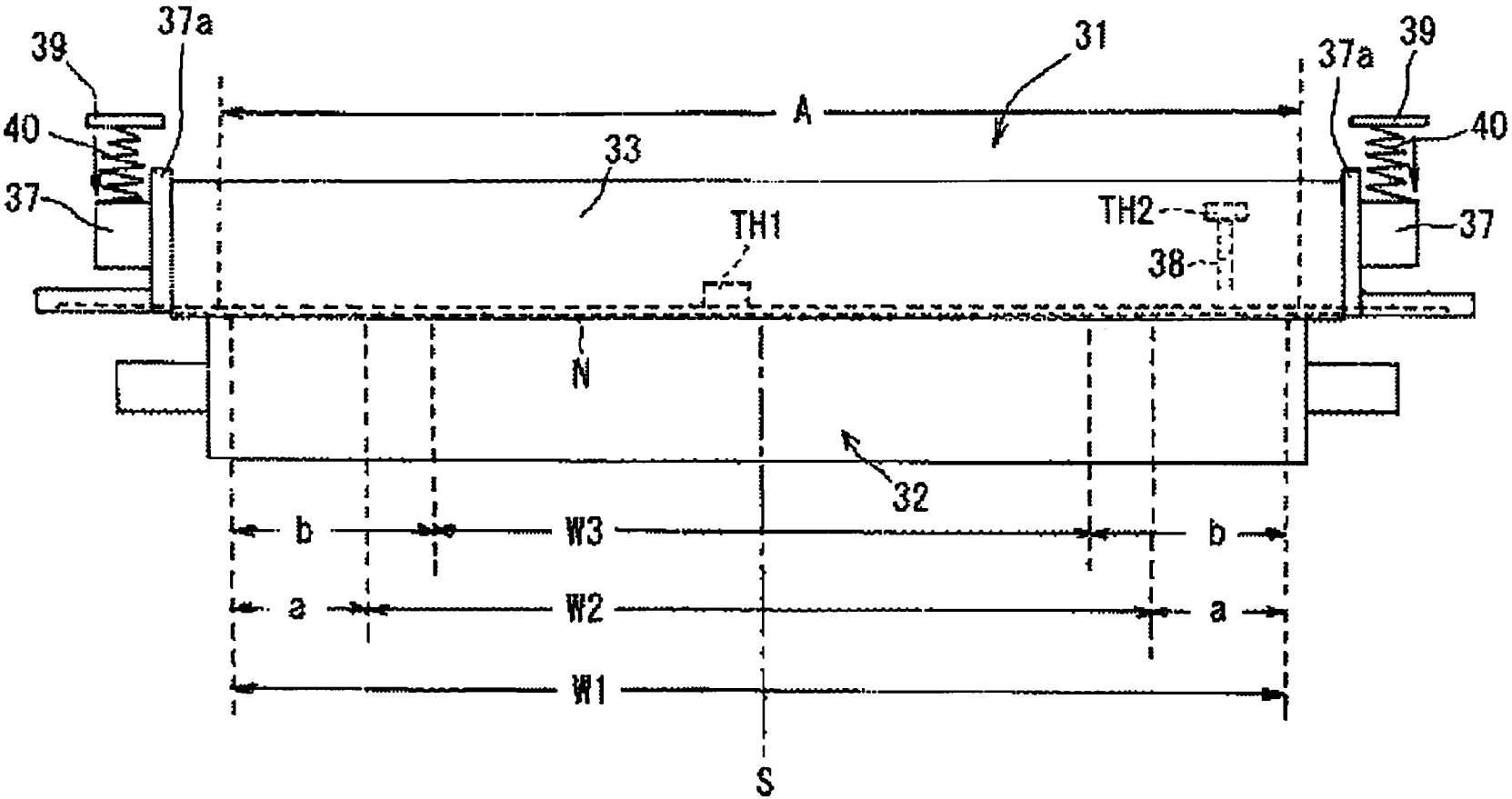
FIG. 3 is a schematic front view of a fixing mechanism portion of the fixing apparatus.
Figure 4:
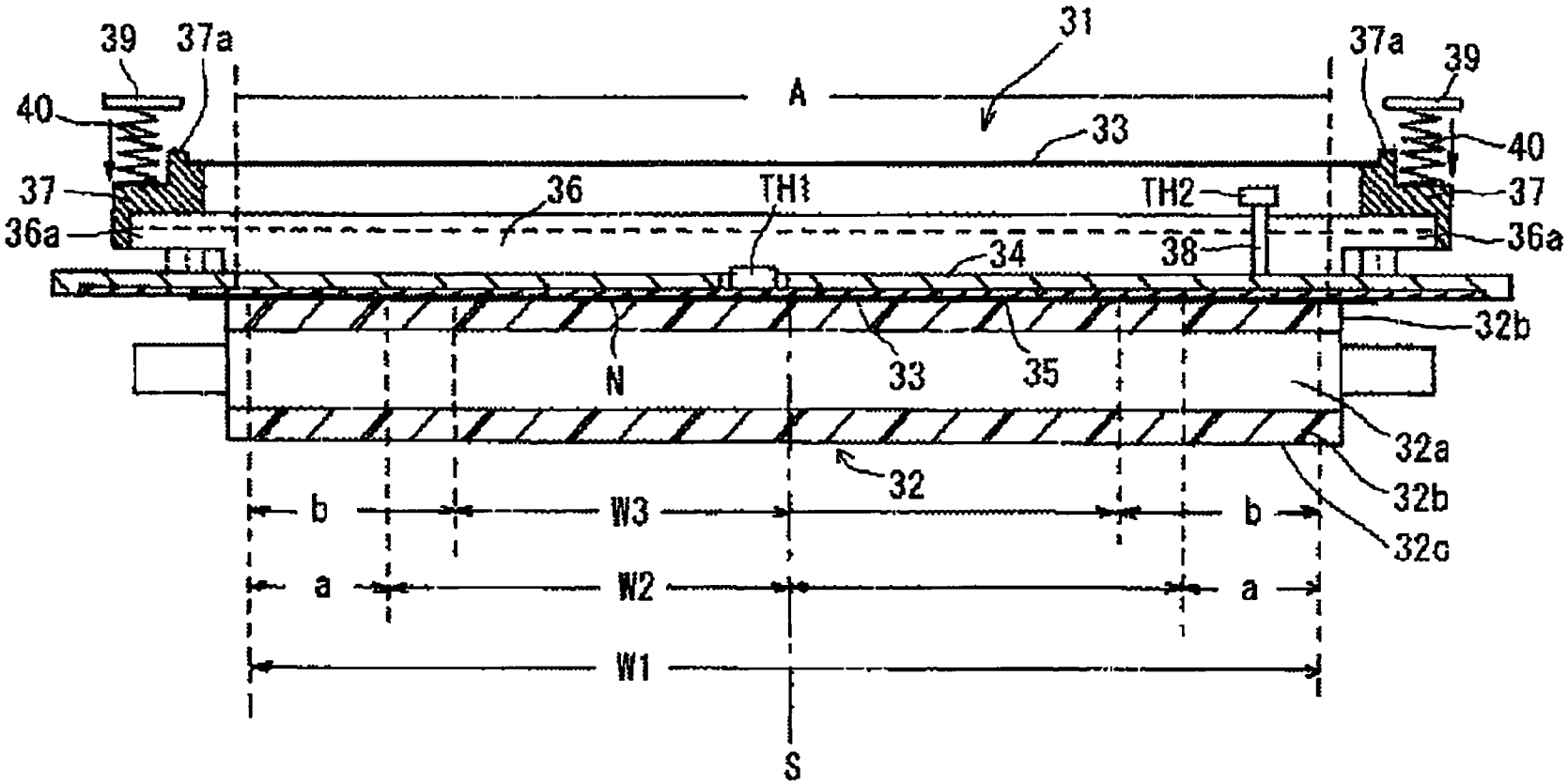
FIG. 4 is a vertical sectional front view which schematically illustrates the fixing mechanism portion.

FIG. 1 is a side sectional view which schematically illustrates the general configuration of the fixing device 20. The fixing device 20 is roughly divided into a fixing mechanism portion 20A employing a film heating method (belt heating method) and an air blowing cooling mechanism portion 20B. FIG. 3 is a schematic front view and FIG. 4 is a vertical sectional front view of the fixing mechanism portion 20A.

(Fixing Mechanism Portion)

First, the outline of the fixing mechanism portion 20A is described. The fixing mechanism portion 20A is an on-demand fixing device using a film heating method and a pressure roller driving method (tensionless type).

A fixing nip portion (sheet passing nip) portion is configured with pressing contact between a film assembly 31 as a first fixing member (heating member) and an elastic pressure roller 32 as a second fixing member (pressure member).

The film assembly 31 includes the following. The fixing film (fixing belt, thin-walled roller, hereinafter, abbreviated as the film) 33 is flexible and is cylindrically-shaped as the image heating member. A film guide member (hereinafter, abbreviated as the guide member) 34 is heat-resistant and stiff and is approximately semicircularly shaped like a gutter in the side sectional view. A ceramic heater (hereinafter, abbreviated as the heater) 35 is a heating source which is fixedly arranged at the outer surface of the guide member 34, being fitted into a groove portion formed at the guide member 34 along the longitudinal direction. The film 33 is loosely fitted externally to the guide member 34 to which the heater 35 is attached. A stiff pressure stay (hereinafter, abbreviated as the stay) 36 whose side section is E shaped without the center line of the E arranged inside the guide member 34. End holders 37 are respectively press-fitted to externally projecting arm portions 36*a* at the bilateral ends of the stay 36. A flange portion 37*a* is integrally formed with the end holder 37.

The hardness of the pressure roller 32 is decreased by forming an elastic layer 32*b* made of silicone rubber or the like onto a cored bar 32*a*. In order to improve the surface quality, it is also possible to form a fluororesin layer 32*c* such as PTFE, PFA and FEP. The pressure roller 32 is arranged to be a pressure rotating member in the state that both ends of the cored bar 32*a* are rotatably supported by bearing members between bilateral side boards of an apparatus chassis (not illustrated in the drawings).

The film assembly 31 is arranged to be parallel to the pressure roller 32 in the state that the heater 35 side is opposed to the pressure roller 32. Pressure springs 40 are arranged as being compressed respectively between the bilateral end holders 37 and bilateral fixed spring receiving members 39. Accordingly, the stay 36, the guide member 34 and the heater 35 are urged to be pressed toward the pressure roller 32. The fixing nip portion is formed with a predetermined width in the recording material conveying direction between the film 33 and the pressure roller 32 by setting the pressing urge force at a predetermined value so that the heater 35 is pressure-contacted to the pressure roller 32 against the elasticity of the elastic layer 32*b* while sandwiching the film 33.

Figure 5:
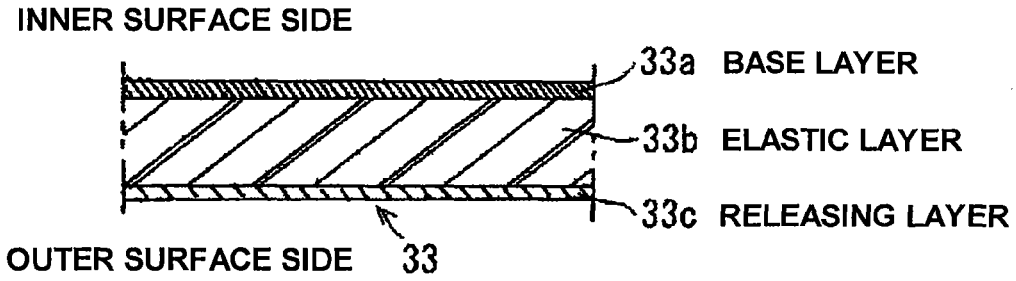
FIG. 5 is a schematic view of the layer configuration of a fixing film.

As illustrated in the schematic view of the layer configuration of FIG. 5, the film 33 of the present embodiment has a three-layer combined configuration of a base layer 33*a*, an elastic layer 33*b* and a toner parting layer 33*c* in the order from the inner surface side to the outer surface side. In order to decrease the heat capacity and improve quick start performance, a heat-resistant film whose thickness is not more than 100 μm, preferably not less than 20 μm and not more than 50 μm, can be used for the base layer 33*a*. For example, a film which is made of polyimide, polyimide-amide, PEEK, PES, PPS, PTFE, PFA, FEP or the like or a metal sleeve which is made of SUS, Ni or the like can be used. A cylindrical SUS sleeve whose diameter is 30 mm is utilized in the present embodiment. Silicone rubber of which rubber hardness is 10 degrees (JIS-A), whose heat conductivity is 1.0 W/m·K, and whose thickness is 300 μm is utilized for the elastic layer 33*b*. A PFA tube layer of a thickness of 30 μm is utilized for the toner parting layer 33*c*.

Figure 6:
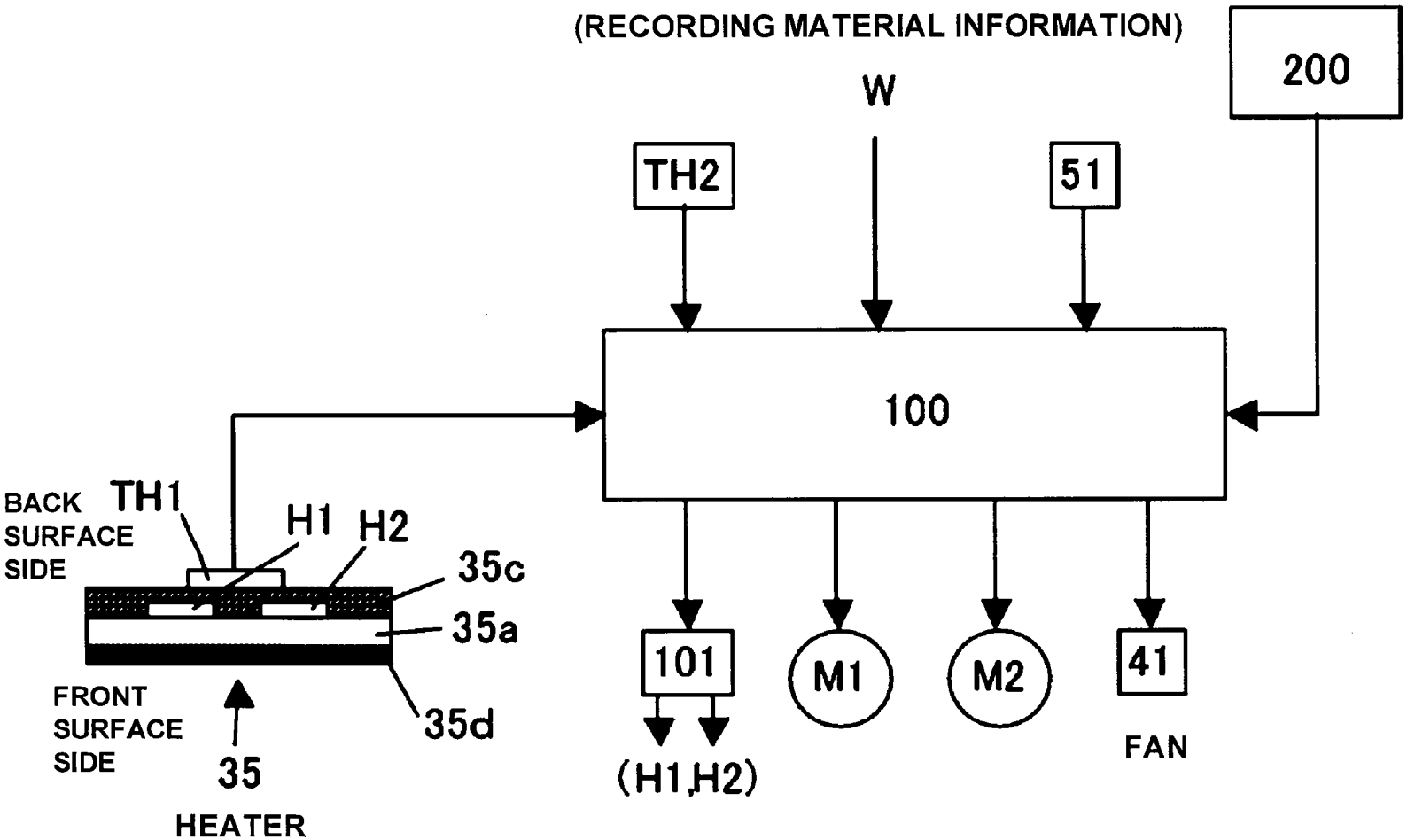
FIG. 6 is a schematic side sectional view of a heater and a block diagram of a control system.

The heater 35 of the present embodiment is a back surface heating type whose heater substrate utilizes aluminum nitride and is a wire heat generator having a small heat capacity extending in the longitudinal direction orthogonal to the movement direction of the film 33 and the recording material P. FIG. 6 is a schematic side sectional view and a control system diagram of the heater 35. The heater 35 has the heater substrate 35*a* which is made of aluminum nitride. Heat generators H1 and H2 are arranged along the longitudinal direction at the back surface side (surface side opposite to the surface opposing to the fixing film) of the heater substrate 35*a*. The heat generators H1 and H2 are formed by coating electro-resistance material such as Ag/Pd (argentum/palladium), for example, with the thickness of about 10 μm and a width of 1 to 5 mm by screen printing. The heat generators H1 and H2 generate heat by being powered. The heat generating distribution thereof is described later. Further, a protecting layer 35*c* made of glass or fluororesin is arranged thereon. In the present embodiment, a slide member (lubrication member) 35*d* is arranged at the front surface side (surface side opposing to the film) of the heater substrate 35*a*.

The heater 35 is fixedly fitted into a groove portion which is formed approximately at the middle part of the outer surface of the guide member 34 along the longitudinal direction of the guide member 34 in the state that the heater substrate front surface side to which the slide member 35*d* is arranged is exposed. The slide member 35*d* surface of the heater 35 and the inner surface of the film 33 are contacted while mutually sliding at the fixing nip portion. Then, the film 33 which is the rotating image heating member is heated by the heater 35.

When electricity is supplied between both ends in the longitudinal direction of the heat generators H1 and H2 of the heater 35, heat is generated at the heat generators H1 and H2 so that the temperature of the heater 35 rapidly rises at the full range of effective heat generating area width A in the heater longitudinal direction. The heater temperature is detected by a first temperature sensor (first temperature detecting means, center part temperature sensor) TH1, such as a thermistor, which is arranged in contact with the outer surface of the protecting layer 35*c*. The output (signal value of the temperature) of the sensor TH1 is input to the control circuit portion 100 via an A/D converter. The control circuit portion 100 controls the power from a power source (power supply portion, heater drive circuit portion) 101 separately to the heat generators H1 and H2 so as to maintain the heater temperature at a predetermined temperature based on the input detection temperature information. Namely, the temperature of the film 33 which is the image heating member heated by the heater 35 is controlled to a predetermined fixing temperature in accordance with the output of the first temperature sensor TH1.

The pressure roller 32 is driven by a motor (driving means) M1 to be rotated in the clockwise direction as indicated by an arrow. The rotation force is applied to the film 33 by the friction force of the pressure roller 32 and the outer surface of the film 33 at the fixing nip portion caused by the rotation of the pressure roller 32. Accordingly, the film 33 is rotated in the counterclockwise direction as indicated by an arrow around the outside of the guide member 34 while the inner surface of the film 33 is sliding in tight contact with the heater 35 at the fixing nip portion (pressure roller drive method). The film 33 is rotated at a circumferential speed approximately corresponding to a circumferential speed of the rotation of the pressure roller 32. In the case that the rotating film 33 is shifted to the left or right along the longitudinal direction of the guide member 34, the bilateral flange portions 37*a* function to receive the belt end part of the shifting side so as to regulate the shifting. In order to decrease the friction force of the mutual sliding of the heater 35 and the inner surface of the film 33 at the fixing nip portion, the slide member 35*d* is arranged at the heater surface at the fixing nip portion so that lubricant such as heat-resistance grease is to be existed against the inner surface of the film 33.

Then, based on a print start signal, the rotation of the pressure roller 32 is started and heating-up of the heater 35 is started. In the state that the circumferential speed of the rotation of the film 33 is stabilized and the temperature of the heater 35 reaches a predetermined value, the recording material P on which a toner image t is borne is introduced to the fixing nip portion as the toner image bearing surface side opposite to the film 33 side. The recording material P passes through the fixing nip portion along with the film 33 in tight contact with the heater 35 via the film 33 at the fixing nip portion. During the process of the passing, heat is added to the recording material P from the film 33 which is heated by the heater 35 and the toner image t is heated and fixed on the recording material P surface. Then, the recording material P which passes through the fixing nip portion is separated from the film 33 to be discharged and conveyed.

In the present embodiment, the conveyance of the recording material P is performed based on the recording material center which is so-called center-based conveyance. Namely, all the recording materials of any width which are capable of passing through the apparatus pass in the state that the center of the recording material in the width direction is aligned with the center of the film 33 in the longitudinal direction. The center baseline for the passing of the recording material (phantom line) is indicated by S.

The sheet passing width of the recording material whose width is the maximum being capable of passing through the apparatus, namely, the maximum sheet passing width, is indicated by W1. In the present embodiment, the maximum sheet passing width W1 is the width of a longitudinal A3 size sheet, which is 297 mm (in A3 longitudinal feeding). The effective heat generating area width A in the heater longitudinal direction is configured to be slightly larger than the maximum sheet passing width W1. The sheet passing width of the recording material whose width is the minimum being capable of passing through the apparatus, namely, the minimum sheet passing width, is indicated by W3. In the present embodiment, the minimum sheet passing width W3 is the width of a longitudinal A4 size sheet, which is 210 mm (in A4 longitudinal feeding). The sheet passing width of the recording material whose width is between the maximum sheet passing width W1 and the minimum sheet passing width W3 is indicated by W2. In the present embodiment, the sheet passing width W2 is the width of a longitudinal B4 size sheet, which is 257 mm (in B4 longitudinal feeding). Hereinafter, the recording material whose width corresponds to the maximum sheet passing width W1 is called a maximum size recording material and the recording material whose width is smaller than the maximum sheet passing width W1 is called a small size recording material.

The width difference portion ((W1-W2)/2) between the maximum sheet passing width W1 and the sheet passing width W2 is indicated by a. The width difference portion ((W1-W3)/2) between the maximum sheet passing width W1 and the minimum sheet passing width W3 is indicated by b. Namely, the width difference portions a and b are the non-sheet passing portions appearing when the recording material of B4 and A4R, which are the small size recording materials, respectively, pass. In the present embodiment, since the recording material passing operation is performed as a center-based operation, the non-sheet passing portions a and b respectively appear at both ends of the sheet passing width W2 or at both ends of the minimum sheet passing width W3. The width of the non-sheet passing portion varies in accordance with the width of the small size recording material which is used for the sheet passing.

The first temperature sensor TH1 is arranged to detect the heater temperature (sheet passing portion temperature) in the area corresponding to the minimum sheet passing width W3. A second temperature sensor (second temperature detecting means, end part temperature sensor) TH2, such as a thermistor, detects the temperature at the non-sheet passing portion. The output (signal value of the temperature) is input to the control circuit portion 100 via the A/D converter. In the present embodiment, the second temperature sensor TH2 is arranged to elastically contact the inner surface of the base layer of the film part corresponding to the non-sheet passing portion a. Specifically, the second temperature sensor TH2 is arranged at the free end of an elastic support member 38 of a plate spring shape whose base part is fixed to the guide member 34. Then, the second temperature sensor TH2 is elastically contacted to the inner surface of the base layer 33*a* of the film 33 with the elasticity of the elastic support member 38 so that the temperature of the film part corresponding to the non-sheet passing portion a is detected.

Here, the first temperature sensor TH1 can be arranged to elastically contact the inner surface of the base layer of the film part corresponding to the minimum sheet passing width W3. On the contrary, the second temperature sensor TH2 can be arranged so as to detect the heater temperature corresponding to the non-sheet passing portion a.

(Air Blowing Cooling Mechanism Portion)

Figure 7:
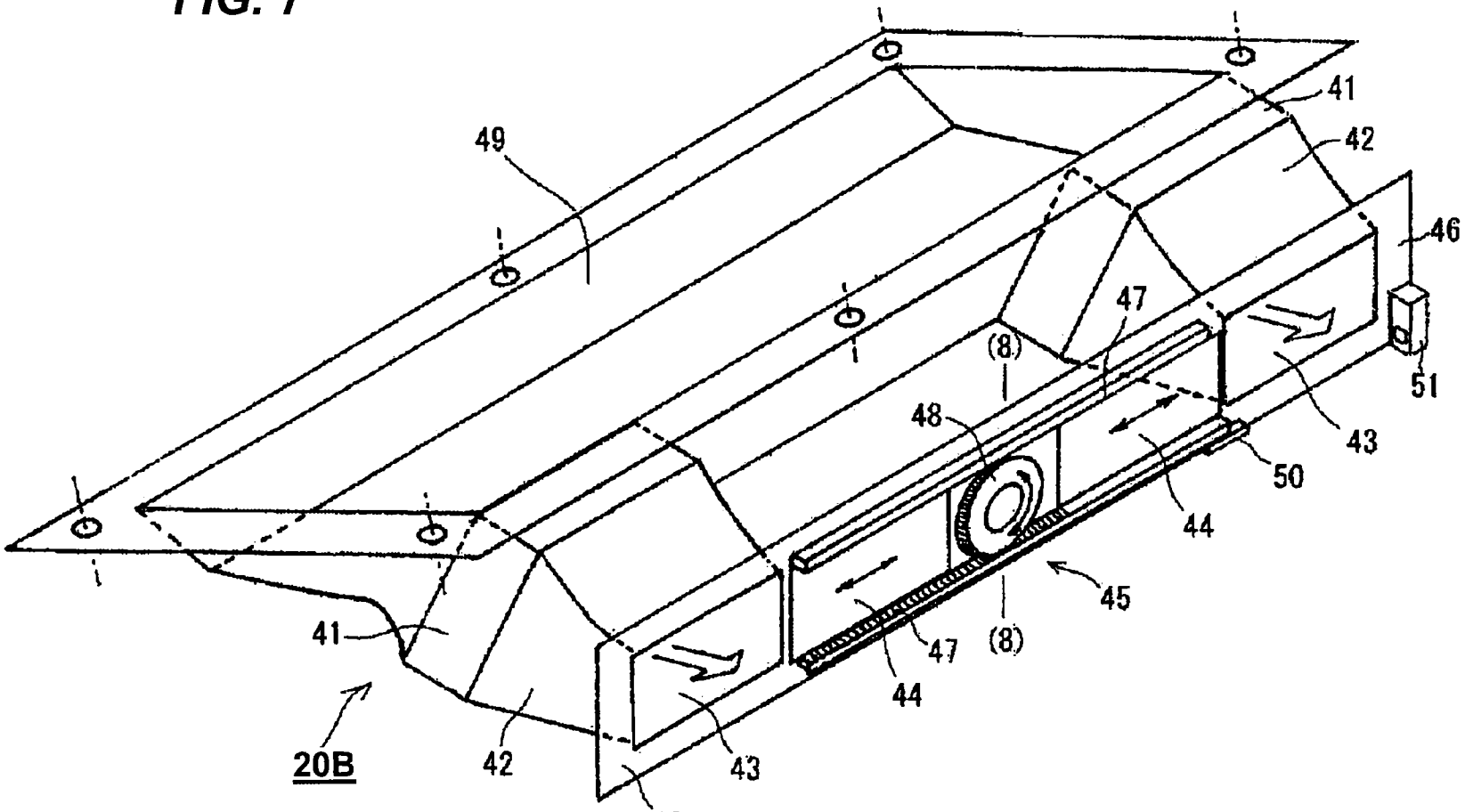
FIG. 7 is a schematic perspective view of an air blowing cooling mechanism portion.
Figure 8:
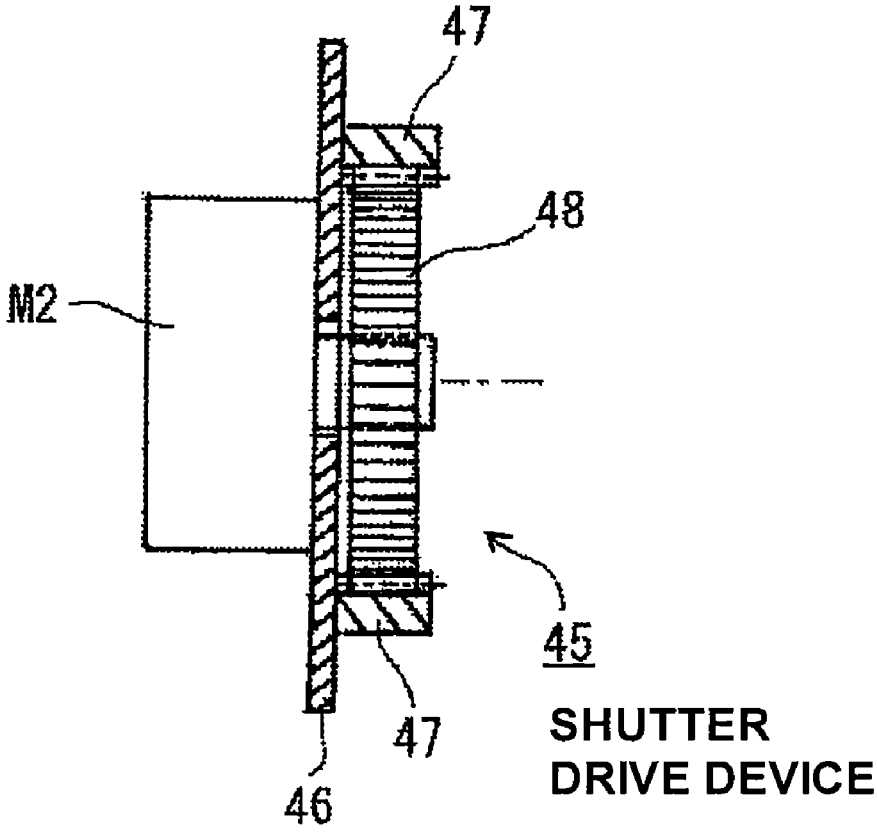
FIG. 8 is an enlarged sectional view along line (8)-(8) in FIG. 7.

The air blowing cooling mechanism portion 20B comprises cooling means which performs air blowing cooling of the at the non-sheet passing portion of the film 33 to decrease the temperature rise generated when the small size recording materials are continuously passing (small size job). FIG. 7 is a schematic perspective view of the air blowing cooling mechanism portion 20B. FIG. 8 is an enlarged sectional view along line (8)-(8) in FIG. 7.

The air blowing cooling mechanism portion 20B in the present embodiment is described with reference to FIG. 1, FIG. 7 and FIG. 8. The air blowing cooling mechanism portion 20B has a cooling fan (hereinafter, abbreviated as the fan) 41 as air blowing means. Further, the air blowing cooling mechanism portion 20B also includes an air blowing duct (air blowing shield body) 42 which introduces air flow generated by the fan 41 and an air blowing port (opening port) 43 which is arranged to the air blowing duct 42 at a part opposing to the fixing mechanism portion 20A. Further, the air blowing cooling mechanism portion 20B also includes a shutter 44 which opens and closes the air blowing port 43, and adjusts the opening width to the width suitable for the width of the passing recording material and a shutter drive device (opening width adjusting means) 45 which drives the shutter.

The fan 41, the air blowing duct 42, the air blowing port 43 and the shutter 44 are arranged to be bilaterally symmetric in the longitudinal direction of the film 33. An intake channel portion is arranged at the intake side of the fan 41. A centrifugal fan such as a sirocco fan can be utilized for the fan 41. Namely, the fan 41 cools a part of the film 33 in the longitudinal direction which is perpendicular to the conveying direction of the recording material with blowing air.

The bilateral shutters 44 are supported to be free to slide in the horizontal direction along a plate surface of a support plate 46 which extends in the horizontal direction and in which the air blowing ports 43 are formed. The bilateral shutters 44 are linked with a rack gear 47 and a pinion gear 48. The pinion gear 48 is driven in forward rotation or reverse rotation by a motor (pulse motor) M2. Accordingly, the bilateral shutters 44 are synchronized and symmetrically open and close the corresponding air blowing ports 43 respectively. The shutter drive device 45 is configured with the support plate 46, the rack gear 47, the pinion gear 48 and the motor M2.

The bilateral air blowing ports 43 are arranged to extend from a position at the center side of the non-sheet passing portion b, which is formed when the minimum width recording material passes to the position of the maximum sheet passing width W1. The bilateral shutters 44 are arranged in the direction to close the air blowing ports 43 by a predetermined amount from the longitudinal center of the support plate 46 toward the outer side.

As illustrated in FIG. 6, the width W of the passing recording material based on information of the user's input of the recording material size or information from an automatic detecting mechanism (not illustrated in the drawings) of the recording material width of the sheet cassette 13 or the manual feeding tray 17 is input to the control circuit portion 100. Then, the control circuit portion 100 controls the shutter drive device 45 based on the information. Namely, by rotating the pinion gear 48 driven by the motor M2 and moving the shutter 44 with the rack gear 47, the air blowing port 43 is opened by a predetermined amount.

Figure 9:
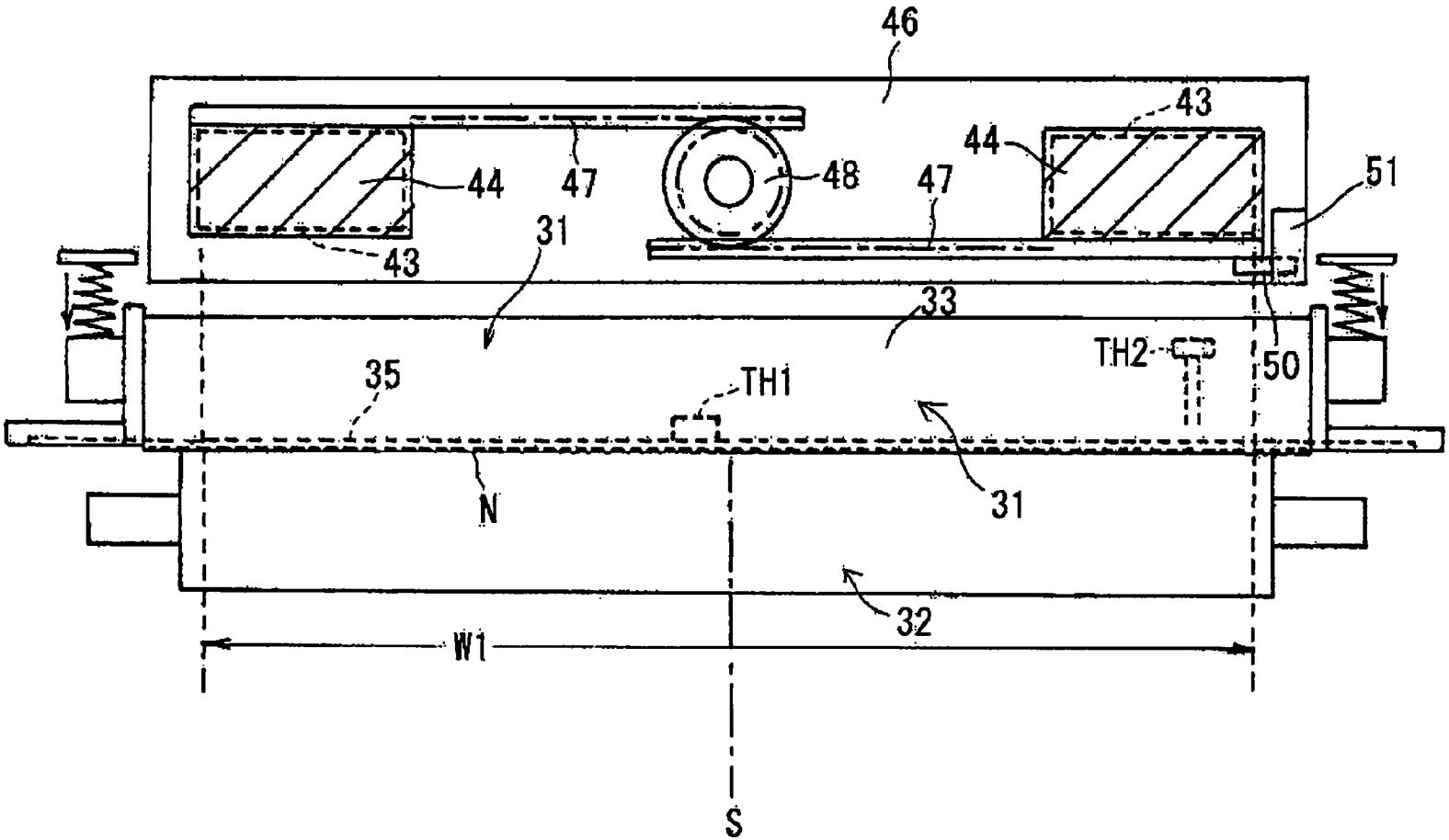
FIG. 9 is a view which illustrates a state that a shutter is moved to a fully closed position where an air blowing port is fully closed.
Figure 10:
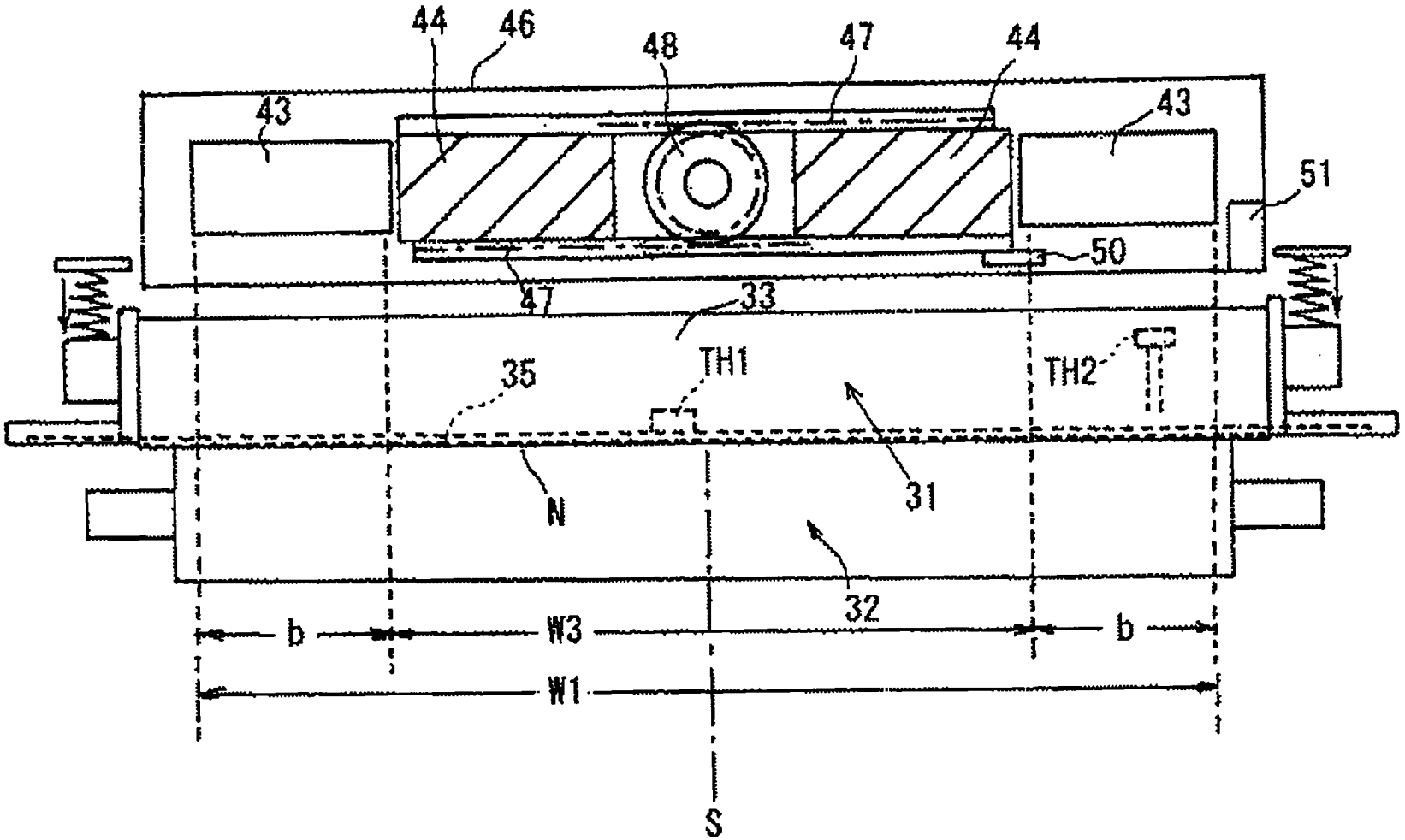
FIG. 10 is a view which illustrates a state that the shutter is moved to a fully opened position where the air blowing port is fully opened.

When the width information of the recording material indicates the maximum size recording material of A3 size width, the control circuit portion 100 controls the shutter drive device 45 to move the shutter 44 to the fully closed position where the air blowing port 43 is fully closed, as illustrated in FIG. 9. When the width information of the recording material indicates the small size recording material of A4R size width, the control circuit portion 100 moves the shutter 44 to the fully opened position where the air blowing port 43 is fully opened, as illustrated in FIG. 10. Further, when the width information of the recording material indicates the small size recording material of B4 size width, the control circuit portion 100 moves the shutter 44 to the position where the air blowing port 43 is opened only at the part corresponding to the non-sheet passing portion a.

Here, when the small size recording material of LTR-R, EXE, K8, LTR or the like is passing, the control circuit portion 100 moves the shutter 44 so as to open the air blowing port corresponding to the non-sheet passing portion which appears respectively for each case.

Namely, the shutter 44 is capable of adjusting the opening width (air blowing width) of the air blowing port 43 in accordance with the width of the recording material.

Here, the recording materials of the minimum size, the maximum size and other sizes are specific sheets which are guaranteed to be accommodated by the image forming apparatus, not sheets of undefined sizes which are originally prepared by a user.

Position information of the shutter 44 is determined by detecting a flag 50 arranged at a predetermined position of the shutter 44 by a sensor 51 arranged on the support plate 46. Specifically, as illustrated in FIG. 9, a home position is determined at the shutter position when the air blowing port 43 is fully closed and the opening amount is detected by the rotation amount of the motor M2.

It is also possible to dispose an opening width detecting sensor which directly detects the current position of the shutter 44. In this case, the control circuit portion 100 can obtain feedback of the shutter position information from the sensor so that the shutter 44 is to be controlled to move to an appropriate opening width position in accordance with the width of the passing recording material. By detecting the edge position of the shutter, the stop position of the shutter is precisely determined in accordance with the length in the width direction of the small size recording material. Therefore, it is possible to perform air blowing with cooling air only toward the non-sheet passing area of all the small size recording materials.

(Operation at Non-Sheet Passing Portion Temperature Rise)

Figure 11:
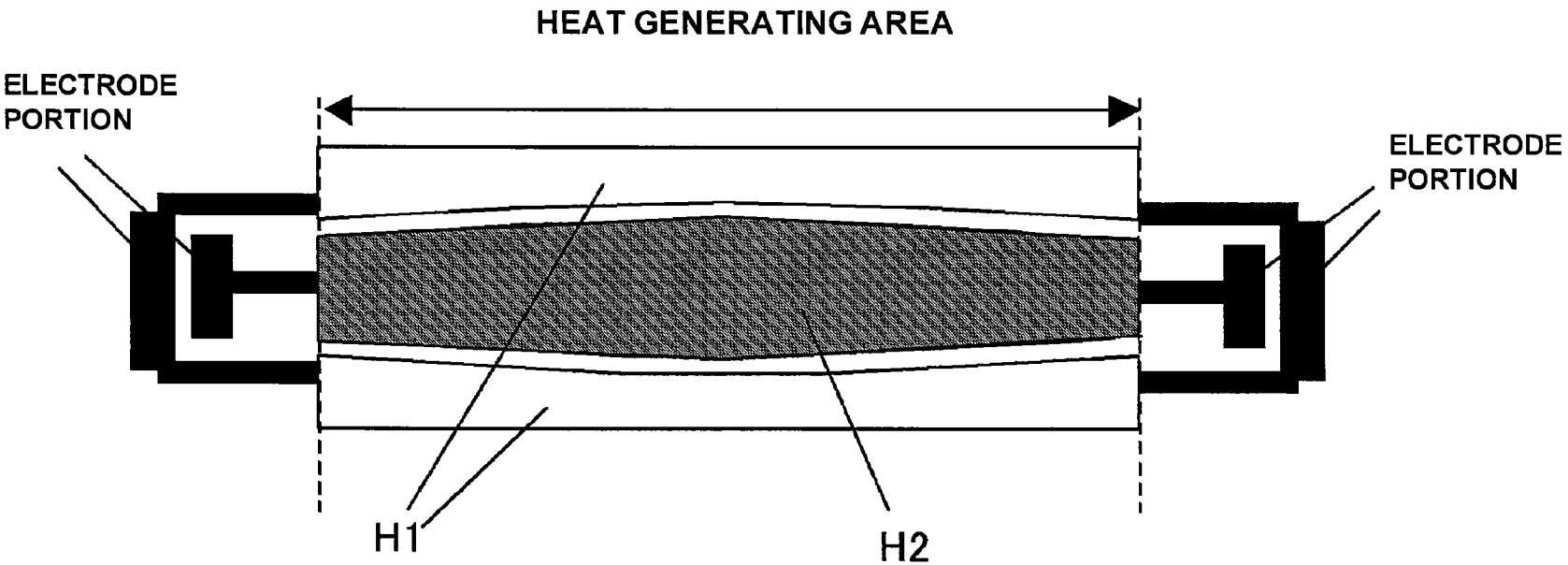
FIG. 11 is a schematic view of the shape of heat generators of the heater and electrode portions according to a first embodiment.
Figure 12:
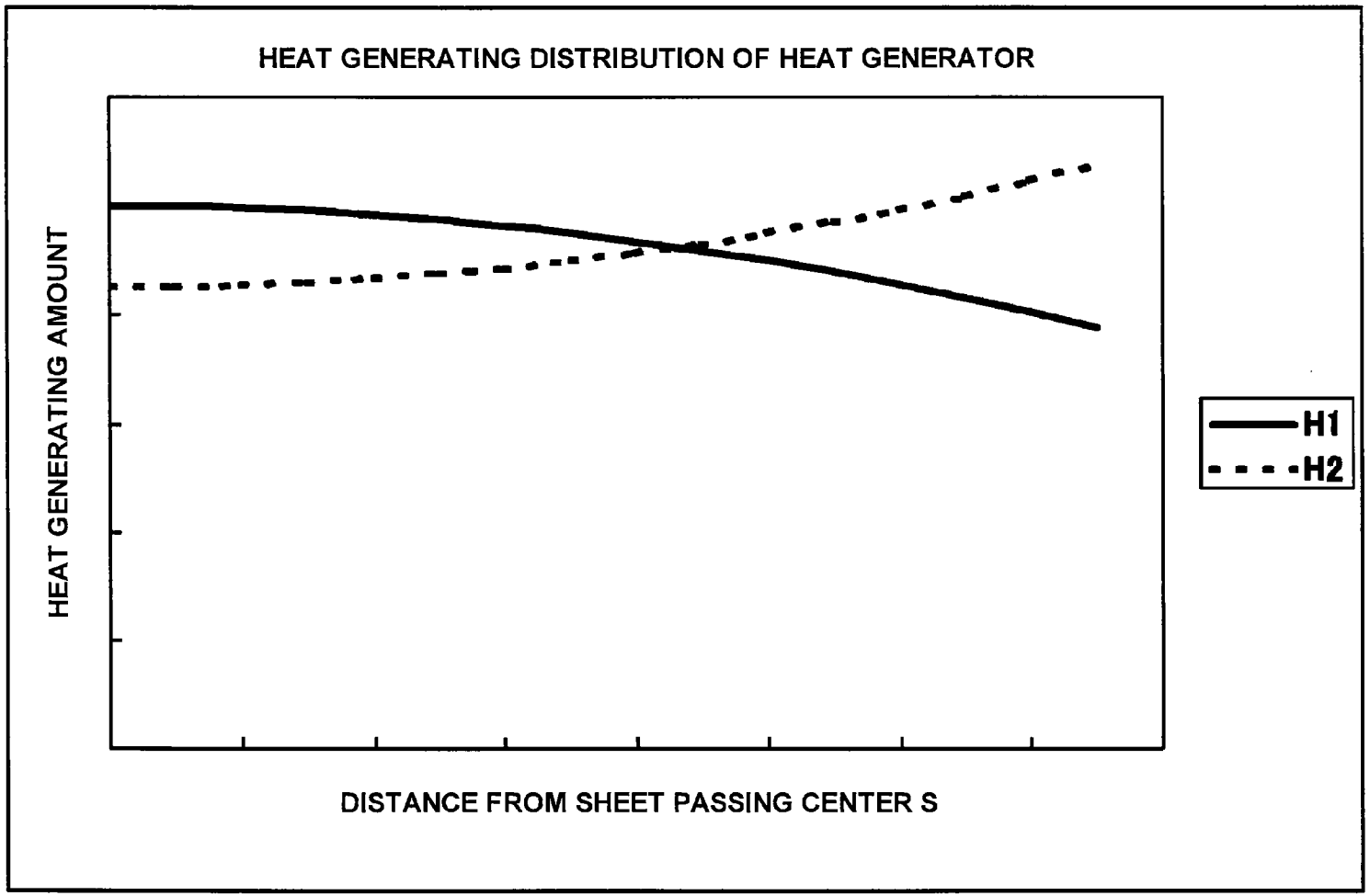
FIG. 12 is a graph which illustrates the heat generating distribution of each of the heat generators according to the first embodiment.

FIG. 11 illustrates the shape of the heat generators H1 and H2 of the heater 35 in the longitudinal direction and electrode portions for powering to the heat generators. FIG. 12 illustrates the heat generating distribution in the longitudinal direction of only one side taking the sheet passing center S as the base when both the heat generators H1 and H2 are respectively powered. The heat generating amount of the heat generator H1 is large at the center in the longitudinal direction and decreases toward the end part. The heat generating amount of the heat generator H2 is small at the center in the longitudinal direction and increases toward the end part. The heat generator shapes are defined by calculating partial resistance value so that each heat generating distribution is to be an approximate quadratic curve and the heat generating distribution when the two heat generators are equally powered is to be flat.

Figure 13:
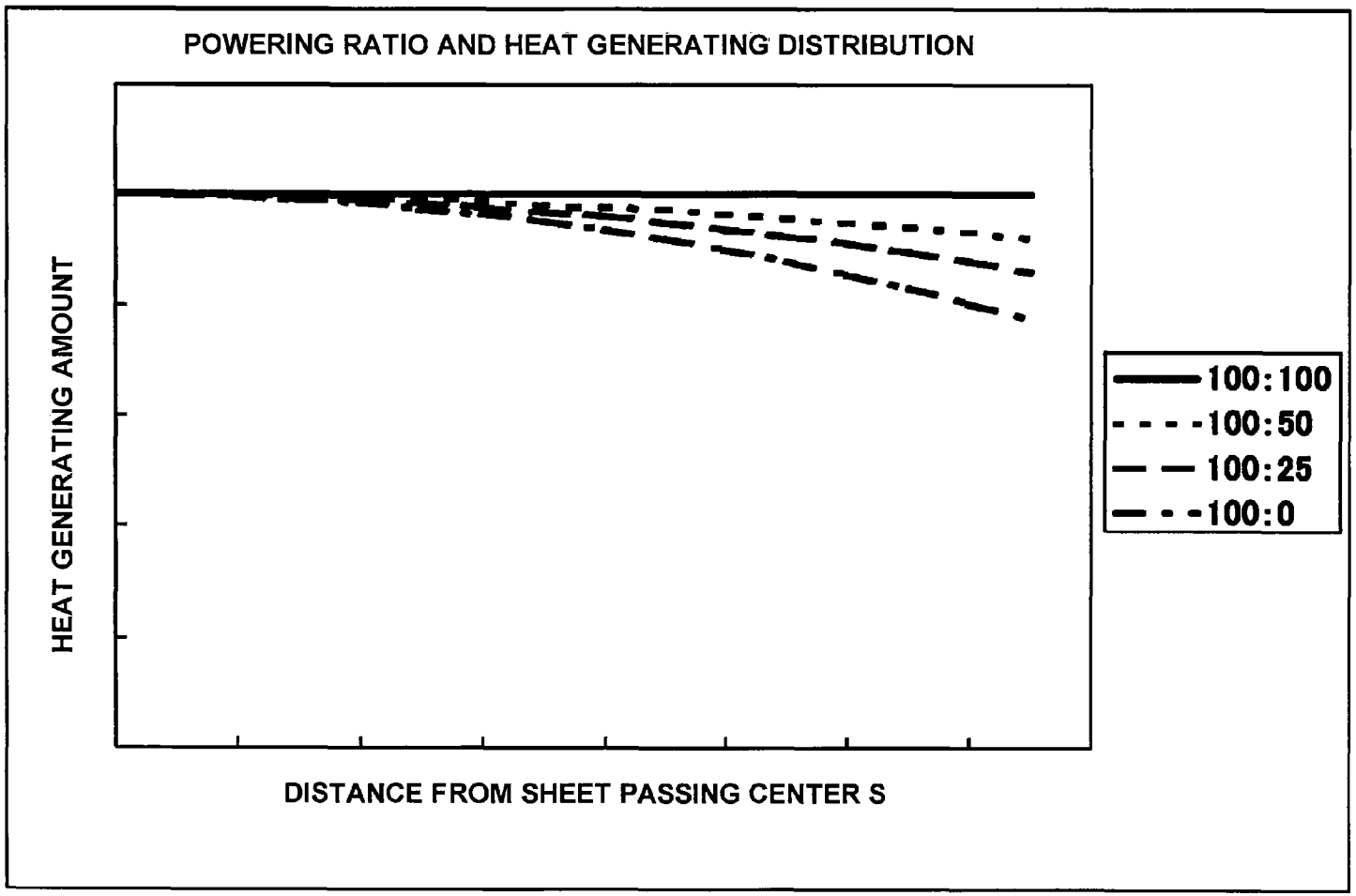
FIG. 13 is a graph which illustrates the heat generating distribution of each of the powering ratios according to the first embodiment.

Next, FIG. 13 illustrates the heat generating distribution when the powering ratio of the heat generator H1 to the heat generator H2 is measured under the condition that the heat generating amounts at the center are equaled. The heat generating distribution can be controlled as illustrated in FIG. 13 by decreasing the powering amount to the heat generator H2 with respect to the powering amount to the heat generator H1, which takes a value of 100. Namely, the heat generating distribution can be changed by changing the powering ratio of the heat generator H1 to the heat generator H2.

The present embodiment has a powering ratio table which determines the ratios of powering to the heat generators H1 and H2 respectively before and after the starting of the cooling operation at the non-sheet passing portion to reduce a temperature rise in accordance with the recording material width W corresponding to the sheet size. Table 1 is the powering ratio table.

TABLE 1

| | | H1:H2 Powering ratio | |
|---|---|---|---|
| Sheet size | Recording material width W(mm) | Before cooling operation | After starting cooling |
| A3 | 297 mm | 100:100 | 100:100 |
| B4 | 257 mm | 100:50:00 | 100:100 |
| A4R | 210 mm | 100:25:00 | 100:50:00 |

As indicated in Table 1, the powering ratio for the small size sheet is set so that the heat generating amount at the end part after starting the cooling operation is larger than that before the cooling operation. For example, when printing of B4 size sheets is performed, the powering ratio before the cooling operation is set to be 100:50 as the recording material width W is 257 mm. Then, the powering ratio after starting the cooling operation is set to be 100:100. Namely, the control circuit portion 100 controls the powering to the heat generators so that the heat generating amount at the area in the longitudinal direction corresponding to the cooling area by the fan 41 during operation of the fan 41 is to be larger than the heat generating amount before starting the cooling operation.

The control circuit portion 100 drives the fan 41 of the air blowing cooling mechanism portion 20B in accordance with the detecting temperature Tsub of the second temperature sensor (second temperature detecting means) TH2. Since the temperature distribution in the non-sheet passing area varies depending on the sheet size, the fan drive temperature Tfan-on to drive the fan 41 is set for each sheet size so that the maximum temperature at the non-sheet passing area is to be equal to or lower than the upper limit temperature for film usage. When the film is continuously used at a temperature exceeding the upper limit temperature for film usage, deterioration of the elastic layer 33*b* or the toner parting layer 33*c* of the film 33 is accelerated by heat and the lifetime of the film is shortened.

Further, a shutter control signal based on the recording material width W is transmitted to the shutter drive device 45, and the motor M2 is driven so that the shutter 44 is moved to the position matching the recording material width W. Namely, by opening the air blowing port part which opposes the non-sheet passing area, the cooling air, which is generated by the fan 41, is blown to the non-sheet passing portion of the fixing mechanism portion 20A. The temperature at the non-sheet passing portion is decreased by receiving the cooling air.

The fan 41 is controlled with the detecting temperature Tsub of the second temperature sensor TH2. Namely, the fan driving is started when the detecting temperature Tsub becomes equal to or higher than the fan drive temperature Tfan-on (cooling operation start temperature). Then, the fan driving is stopped when the detecting temperature Tsub becomes equal to or lower than the fan stop temperature Tfan-off (cooling operation stop temperature) which is lower than the fan drive temperature.

Figure 14:
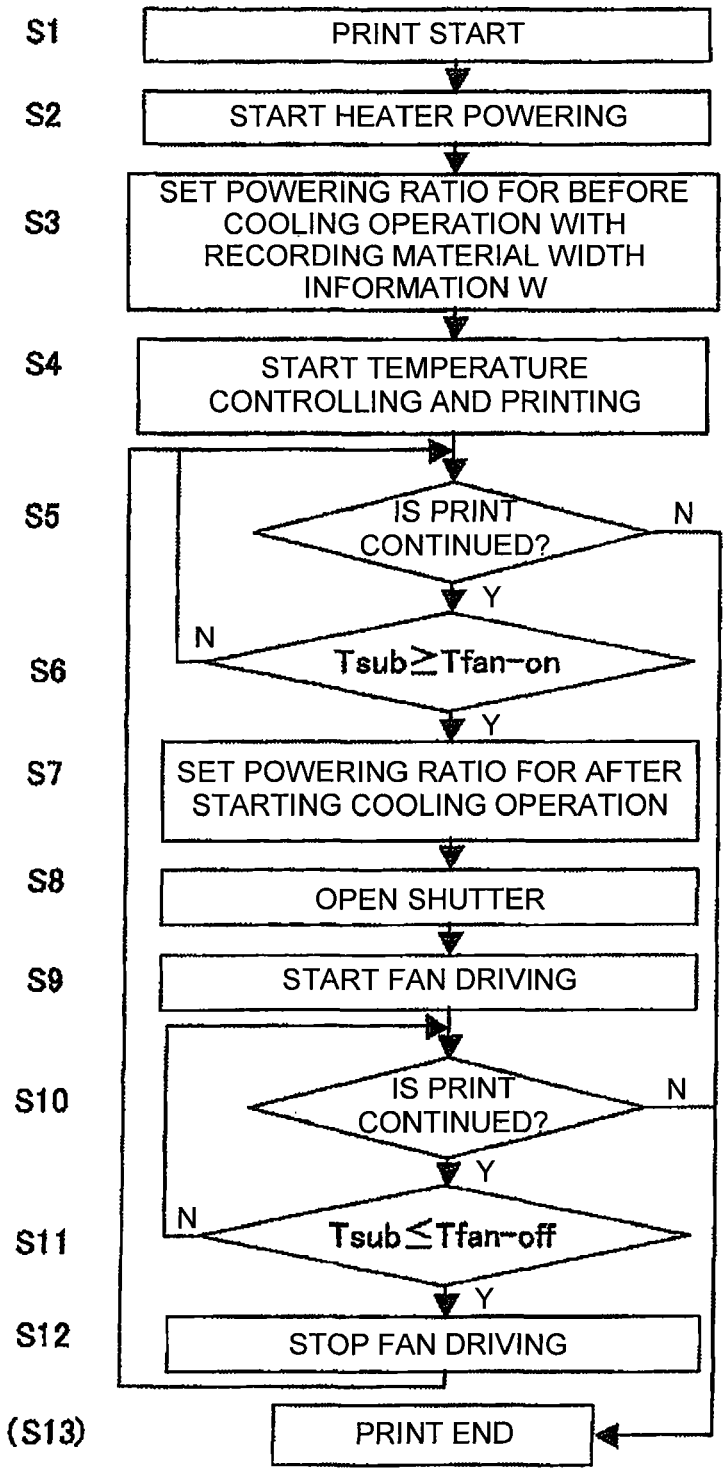
FIG. 14 is a flowchart which describes the powering ratio and the cooling operation during continuous sheet passing according to the embodiments.

The operation at the non-sheet passing portion to reduce a temperature rise in the case that the recording materials are continuously passing is described based on FIG. 14.

When a print start signal is received (step S1), the powering to the heater 35 is started (step S2). Accordingly, the operation of increasing the temperature of the fixing apparatus is started. Next, the powering ratio of the heat generators H1 and H2 before the cooling operation is set with the recording material width information W (step S3). When the temperature of the fixing apparatus reaches a predetermined temperature, temperature control is performed so that the temperature of the first temperature sensor TH1 is to be a predetermined fixing temperature and the print operation starts (step S4).

Then, in the case that the printing is not continued (step S5), the printing ends (step S13). On the other hand, in the case that the printing is continued, when the detecting temperature Tsub of the second temperature sensor TH2 becomes equal to or higher than the fan drive temperature Tfan-on during printing (step S6), the powering ratio of the heat generators H1 and H2 is changed to that for after starting cooling (step S7). Then, the shutter 44 is opened based on the recording material width W (step S8) and the driving of the fan 41 starts (step S9).

In the case that the printing is continued (step S10), when the detecting temperature Tsub of the second temperature sensor TH2 becomes equal to or lower than the fan stop temperature Tfan-off (step S11) due to the cooling of the non-sheet passing area by the fan 41, the driving of the fan 41 stops (step S12). Here, in the case that the printing is not continued in step S10, the printing ends (step S13).

Figure 15:
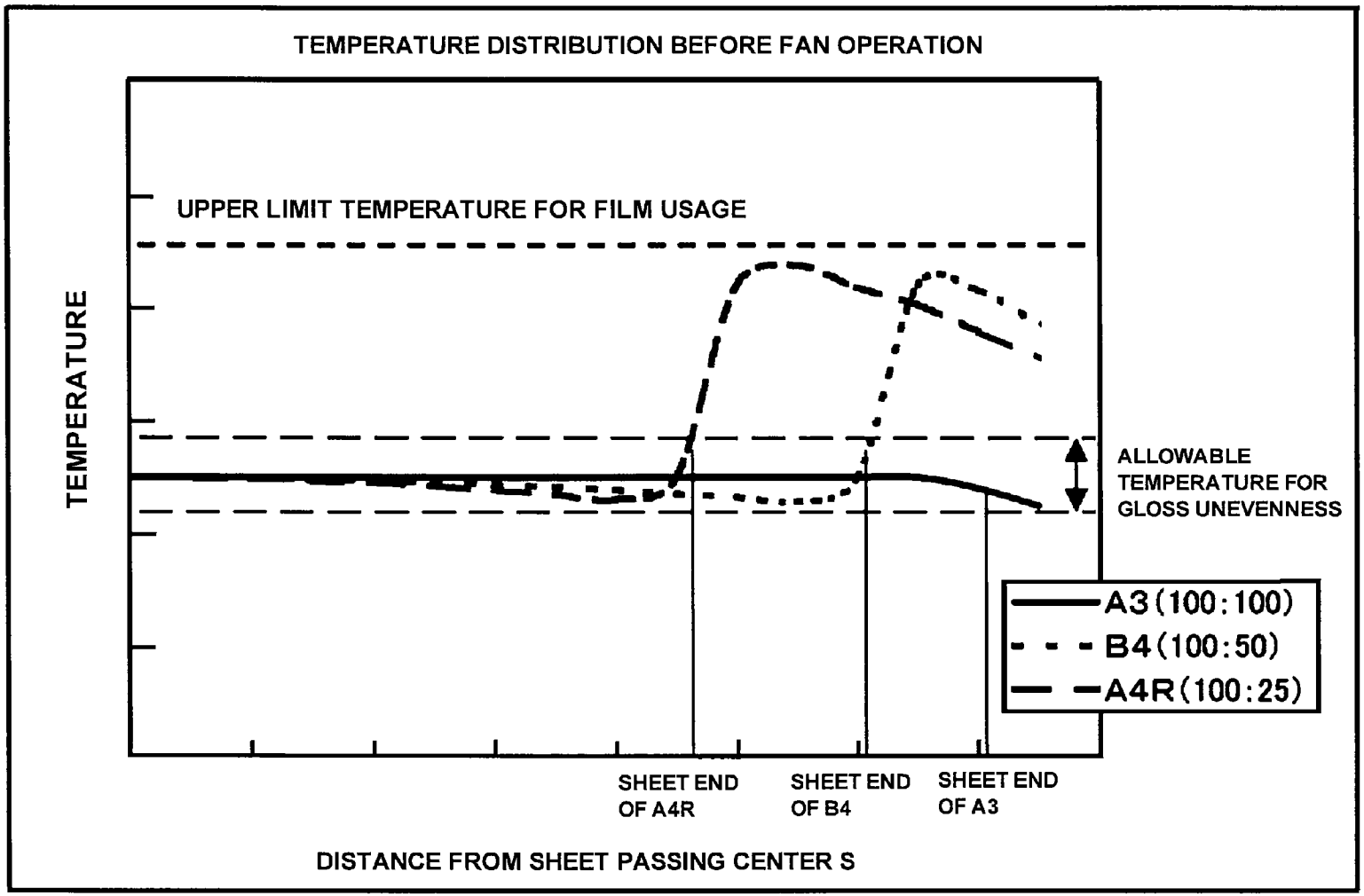
FIG. 15 is a graph which illustrates the film temperature distribution before the cooling operation according to the first embodiment.

FIG. 15 illustrates the temperature distribution of the film surface just before starting the cooling operation in the case that the recording materials of each size are continuously passing based on the present embodiment. As illustrated in FIG. 15, an area whose temperature is lower than that of the center part is generated at the inside of the end part of the sheets as the temperature distribution is caused by the heat generating distribution. The temperature at the end part of the small size sheets is increased to be higher than that at the center part due to the transfer of the non-sheet passing portion temperature rise. However, the temperature distribution in the sheet passing area is to be within the temperature range allowable for the unevenness in gloss. In addition, the temperature in the non-sheet passing area is to be below the upper limit temperature for film usage.

Figure 16:
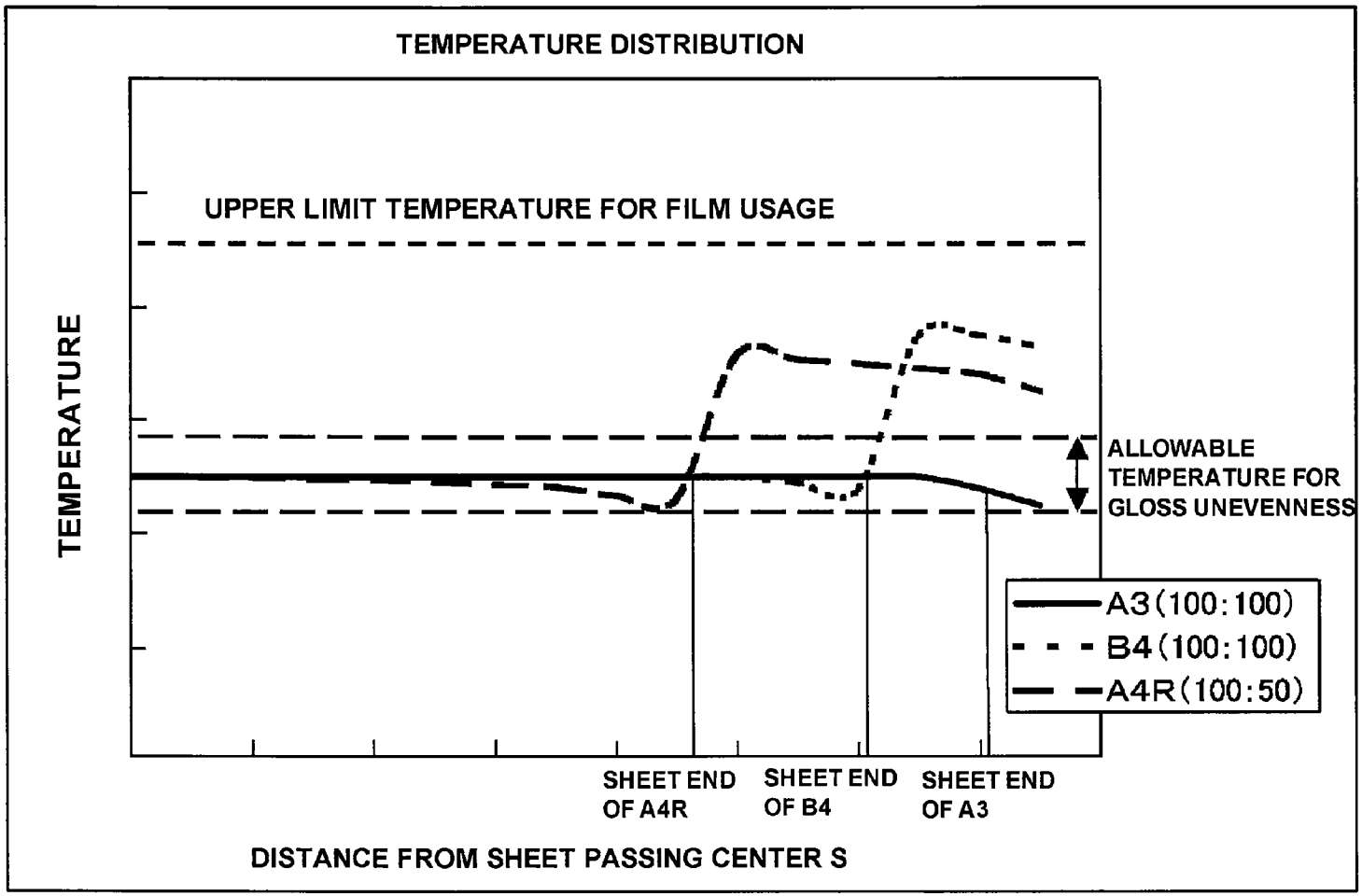
FIG. 16 is a graph which illustrates the film temperature distribution after the cooling operation according to the first embodiment.

FIG. 16 illustrates the temperature distribution of the film surface just before the fan driving stops in the case that the recording materials are continuously passing after the cooling operation is started. The temperature at the vicinity of the sheet end part is decreased due to the deviated flow of blowing air. However, the temperature distribution in the sheet passing area is to be within the temperature range allowable for the unevenness in gloss by appropriately setting the powering ratio. In addition, the temperature in the non-sheet passing area is decreased by the cooling operation.

When the continuous sheet passing is further continued, the temperature distribution of the film surface fluctuates between the temperature distributions of FIG. 15 and FIG. 16 due to the on-off control of the fan 41.

As described above, in the present embodiment, with the image heating apparatus which performs the cooling operation while controlling the heat generating distribution, unevenness in gloss and poor fixing of the image caused by the deviated flow of blowing air by the cooling means can be solved while cooling the temperature at the non-sheet passing area into the temperature range allowable for usage of the heating member.

Comparison Example

A comparison example is described as the case that only the cooling operation of the fan 41 is performed without changing the powering ratio of the heat generators H1 and H2 when the non-sheet passing portion temperature rise occurs. The rest of the configuration is the same as the above first embodiment.

Table 2 indicates the powering ratios which are previously set for each recording material width W corresponding to the sheet size.

TABLE 2

| Sheet size | Recording material width W (mm) | H1:H2 Powering ratio |
|---|---|---|
| A3 | 297 mm | 100:100 |
| B4 | 257 mm | 100:50:00 |
| A4R | 210 mm | 100:25:00 |

Figure 17:
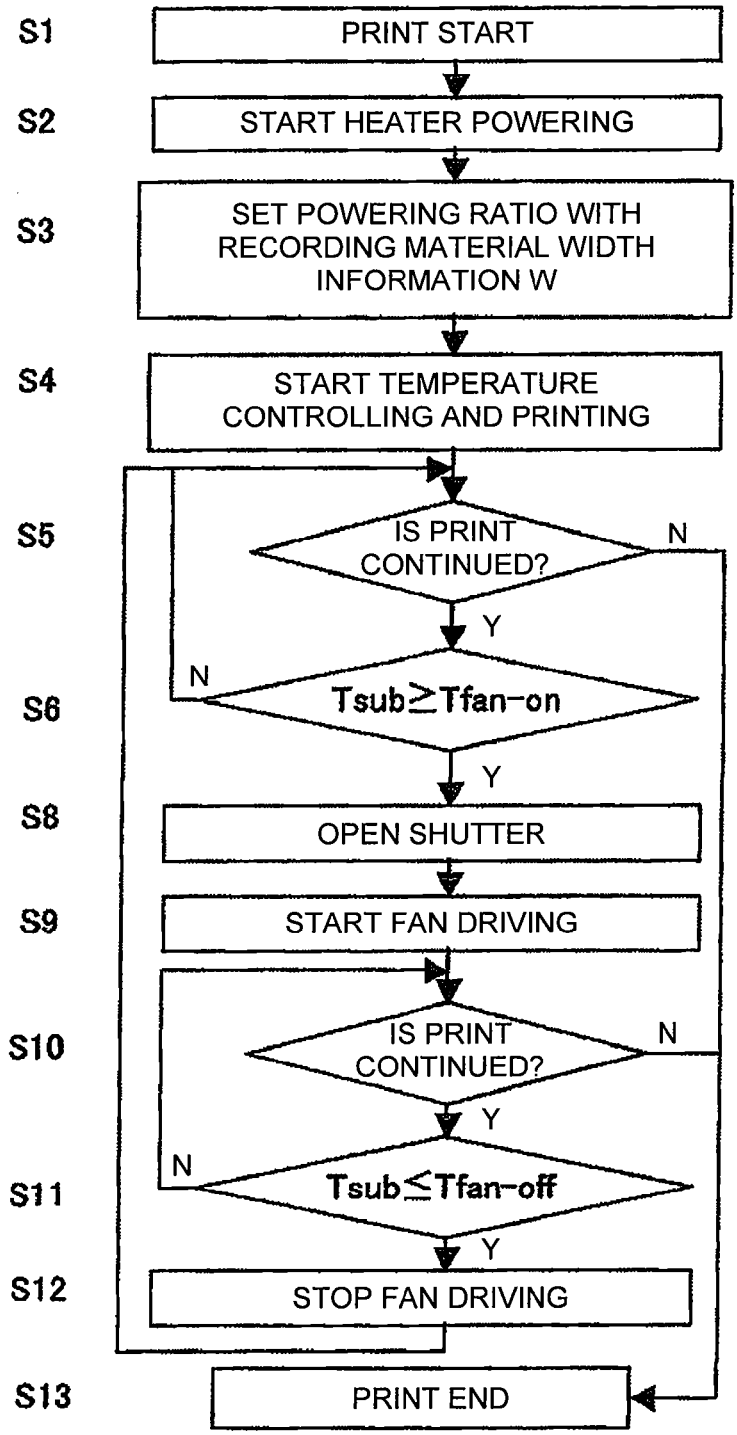
FIG. 17 is a flowchart which describes the powering ratio and the cooling operation during continuous sheet passing of a comparison example.

The operation at the non-sheet passing portion to reduce a temperature rise of the comparison example is described in FIG. 17. The same numerals are given to the same step of the flowchart in FIG. 14 and a redundant description thereof is omitted. In the flowchart of the comparison example, the step corresponding to step S7 in FIG. 14 is not executed. Namely, the flowchart in FIG. 17 differs from that in FIG. 14 in that the powering ratio is simply set in step S3 before starting printing and remains constant for each sheet size regardless of the cooling operation.

Figure 18:
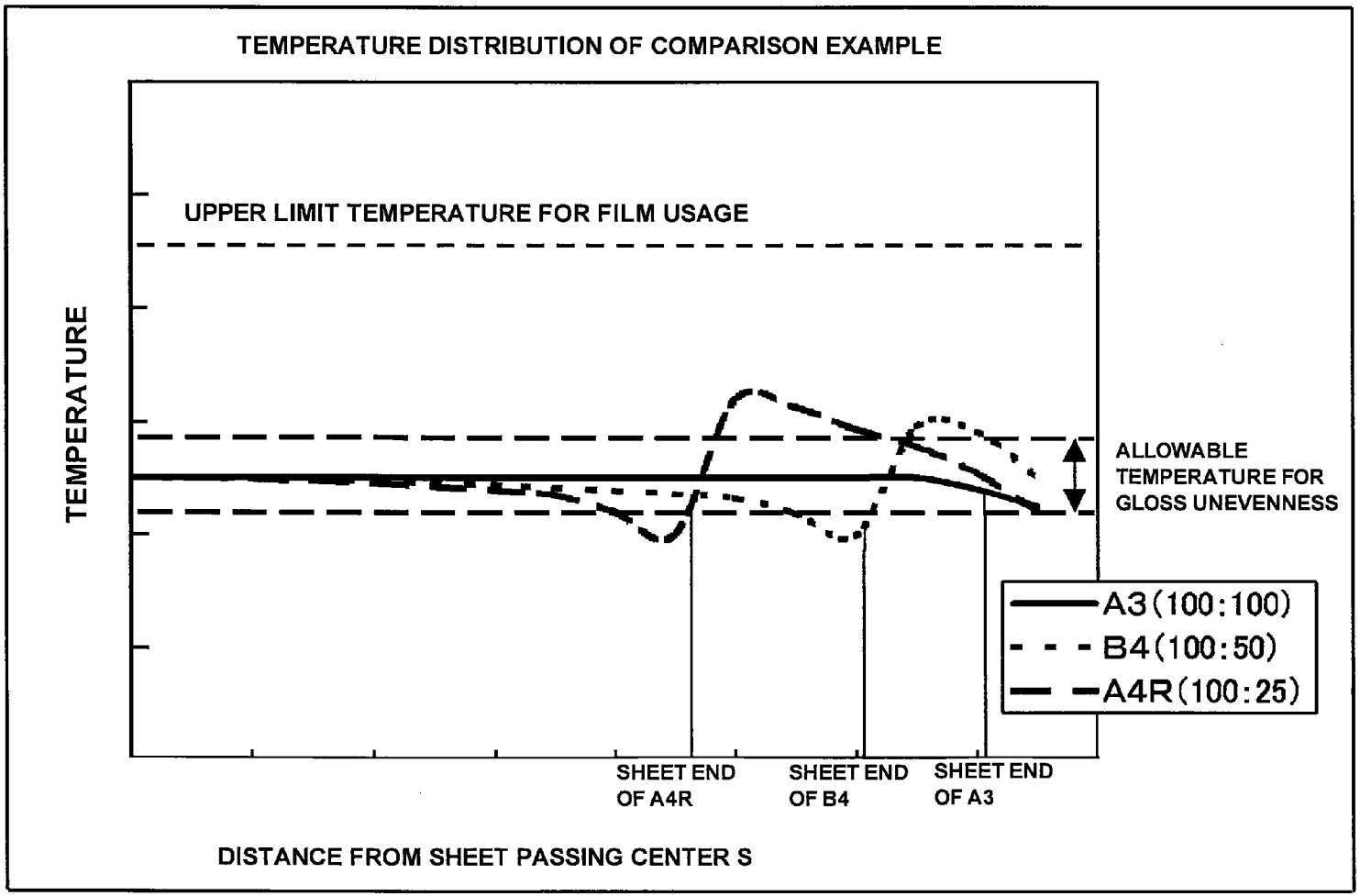
FIG. 18 is a graph which illustrates the film temperature distribution after the cooling operation of the comparison example.

The temperature distribution before starting the cooling operation is the same as that of the first embodiment which is illustrated in FIG. 15. FIG. 18 illustrates the temperature distribution of the film surface just before the fan driving stops in the case that the continuous sheet passing is continued after the cooling operation is started. In this case, the temperature in the vicinity of the sheet end part is decreased due to the deviated flow of blowing air and the temperature at the sheet end part is to be below the allowable temperature for unevenness in gloss.

When the recording material with a solid image passes in this condition, poor gloss occurs at the sheet end part. Further, poor fixing occurs in the case that the grammage of the recording material is large or that the environmental temperature is low.

Second Embodiment

Figure 19:
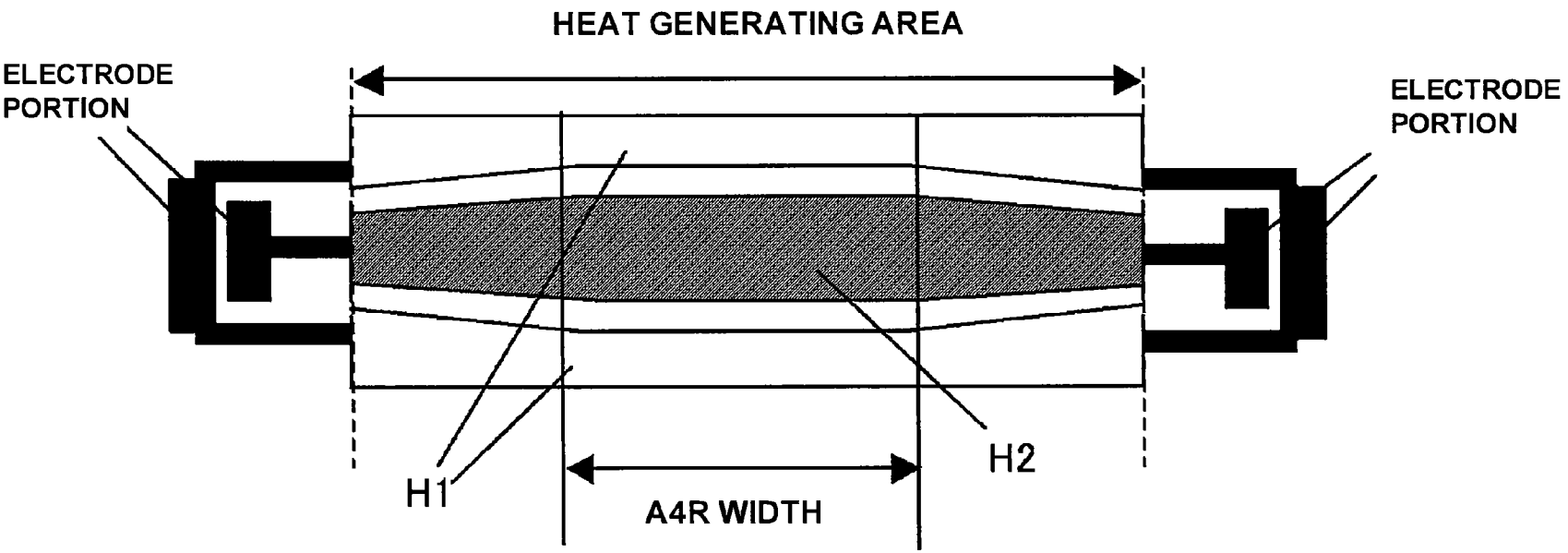
FIG. 19 is a schematic view of the shape of heat generators of the heater and electrode portions according to a second embodiment.
Figure 20:
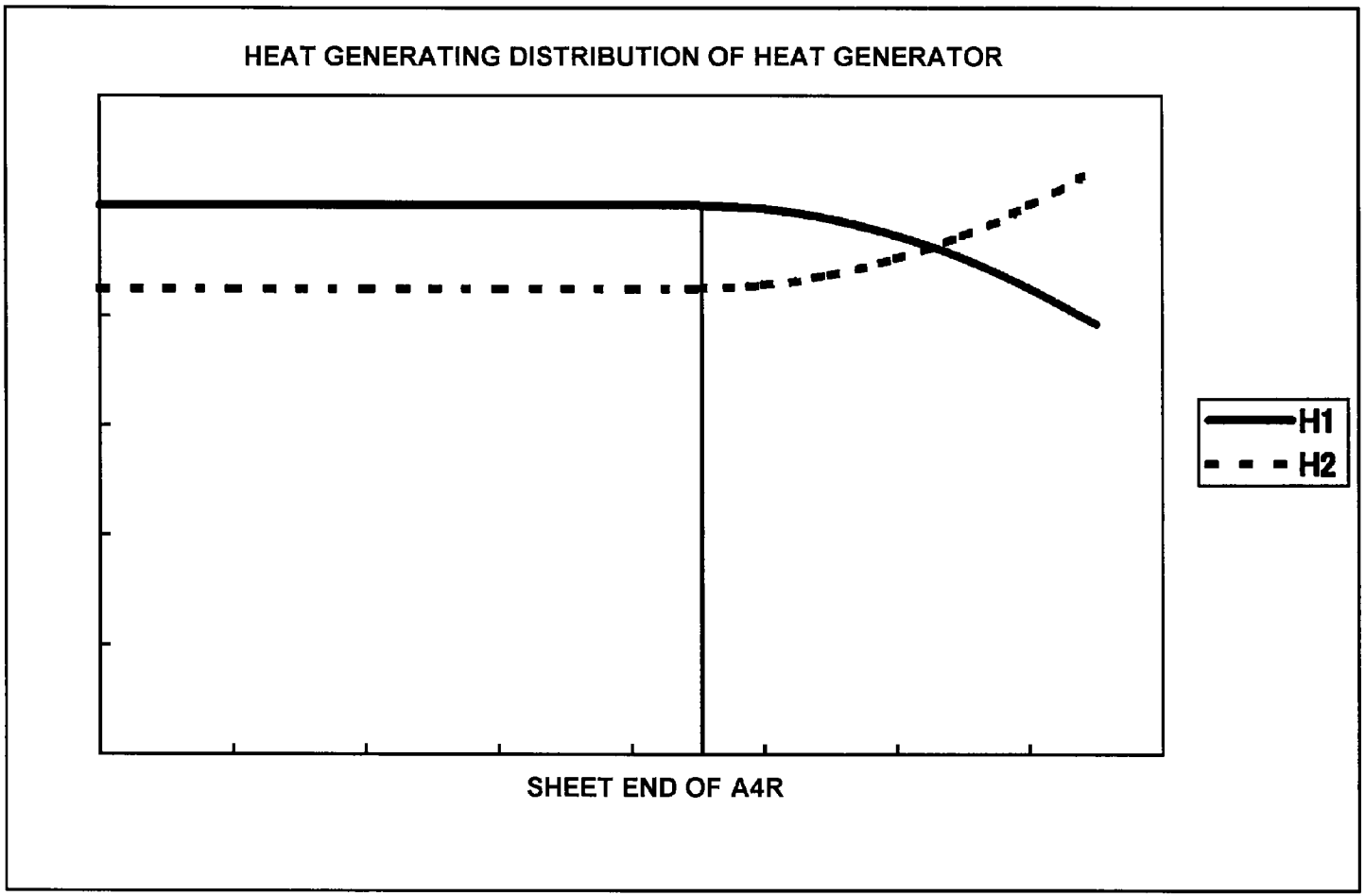
FIG. 20 is a graph which illustrates the heat generating distribution of each heat generators according to the second embodiment.
Figure 21:
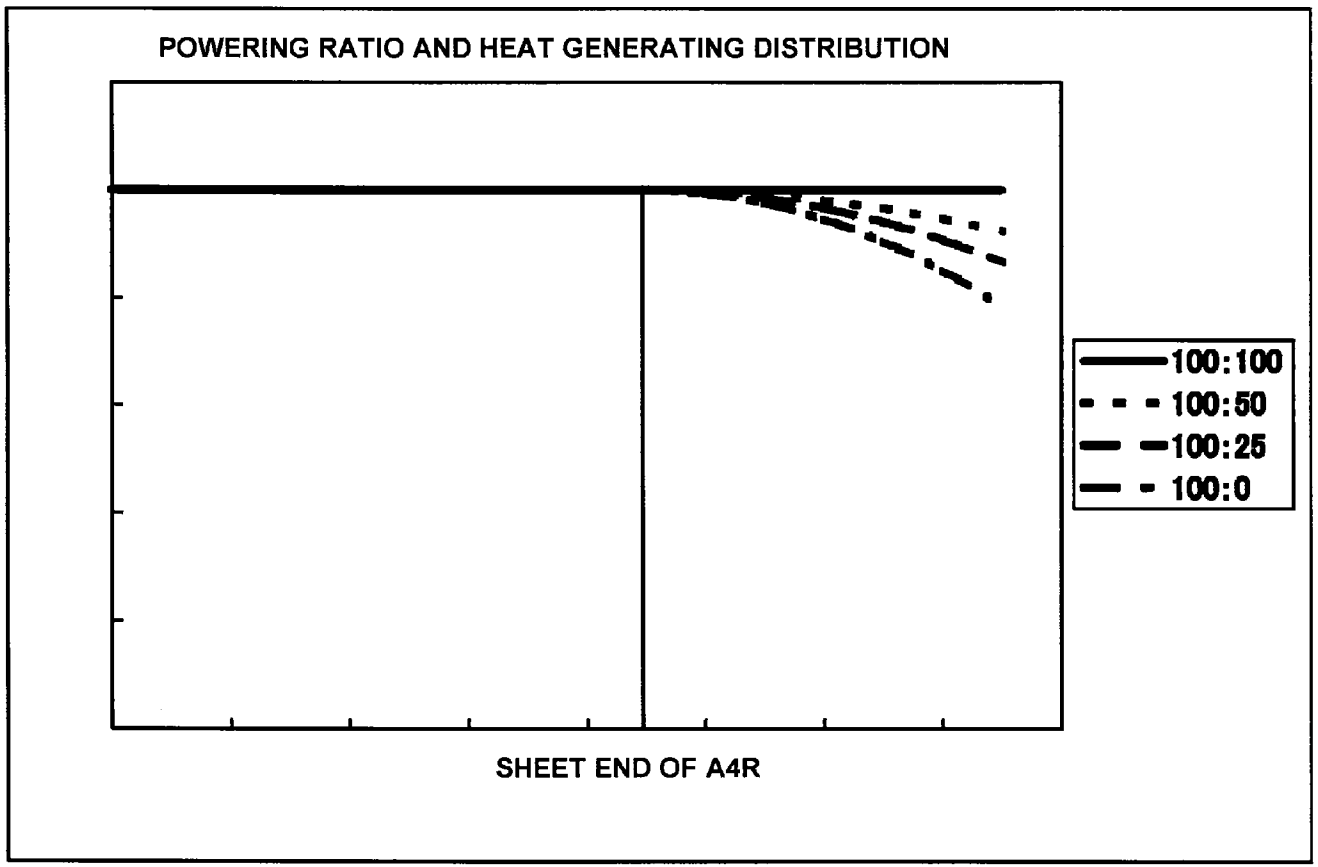
FIG. 21 is a graph which illustrates the heat generating distribution of each of the powering ratios according to the second embodiment.
Figure 22:
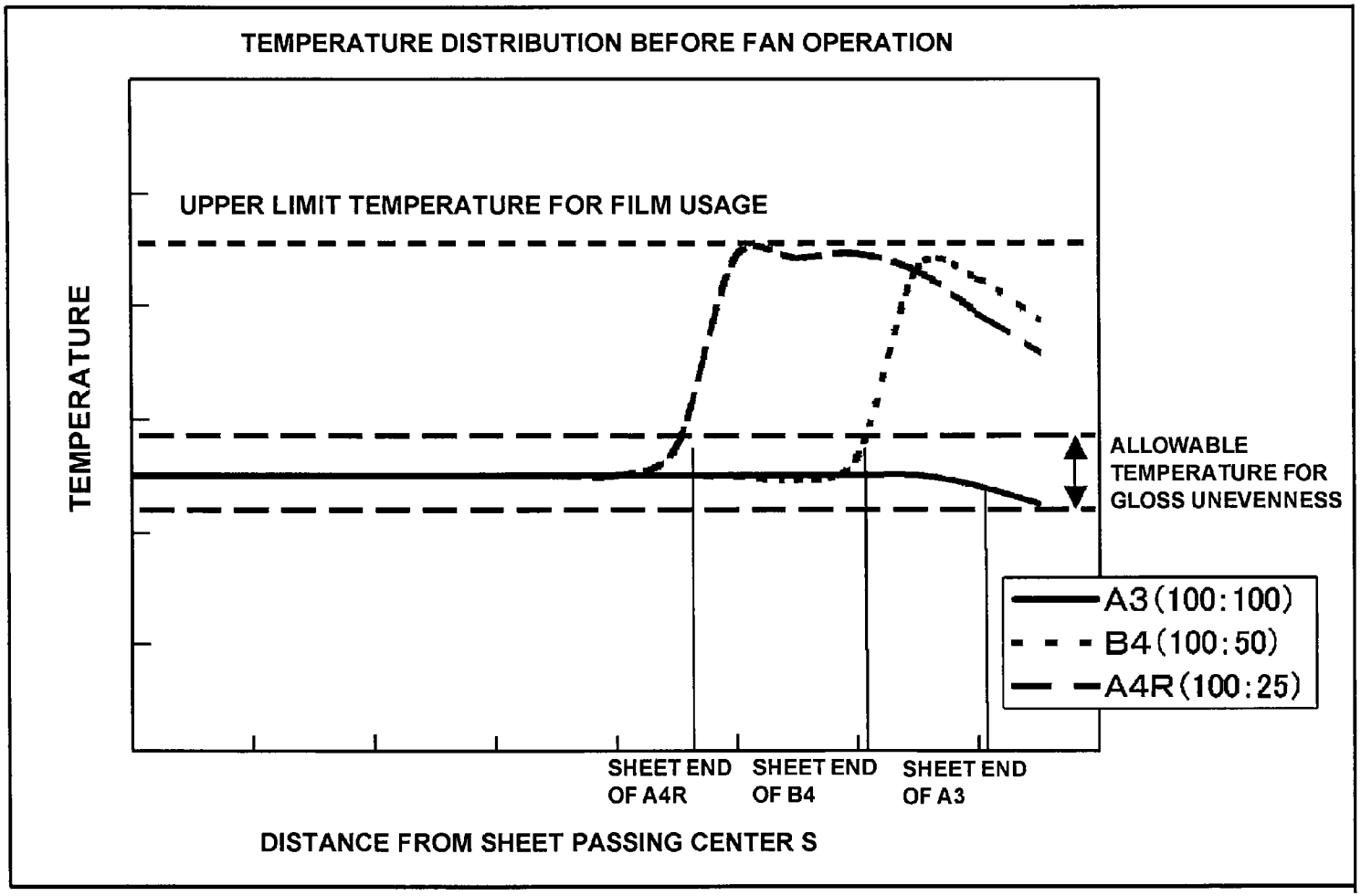
FIG. 22 is a graph which illustrates the film temperature distribution before the cooling operation according to the second embodiment.

In the second embodiment, the shape of the heat generators H1 and H2 of the heater of the first embodiment is changed as illustrated in FIG. 19. Here, the rest of the configuration is the same as the first embodiment. As illustrated in FIG. 20, the heat generating distribution of each of the heat generators H1 and H2 is to be even in the sheet passing area of A4R size which is the minimum size. In the second embodiment, the heat distribution is to be even with the constant width of the heat generators in the sheet passing area of A4R. By configuring the apparatus as mentioned above, the heat generating distribution can be controlled as illustrated in FIG. 21. FIG. 22 illustrates the temperature distribution of the film surface just before starting the cooling operation while the powering ratio before the cooling operation is set as shown Table 1, being same as the first embodiment. In this case, the temperature distribution in the sheet passing area is to be within the allowable range for producing an unevenness in gloss.

Figure 23:
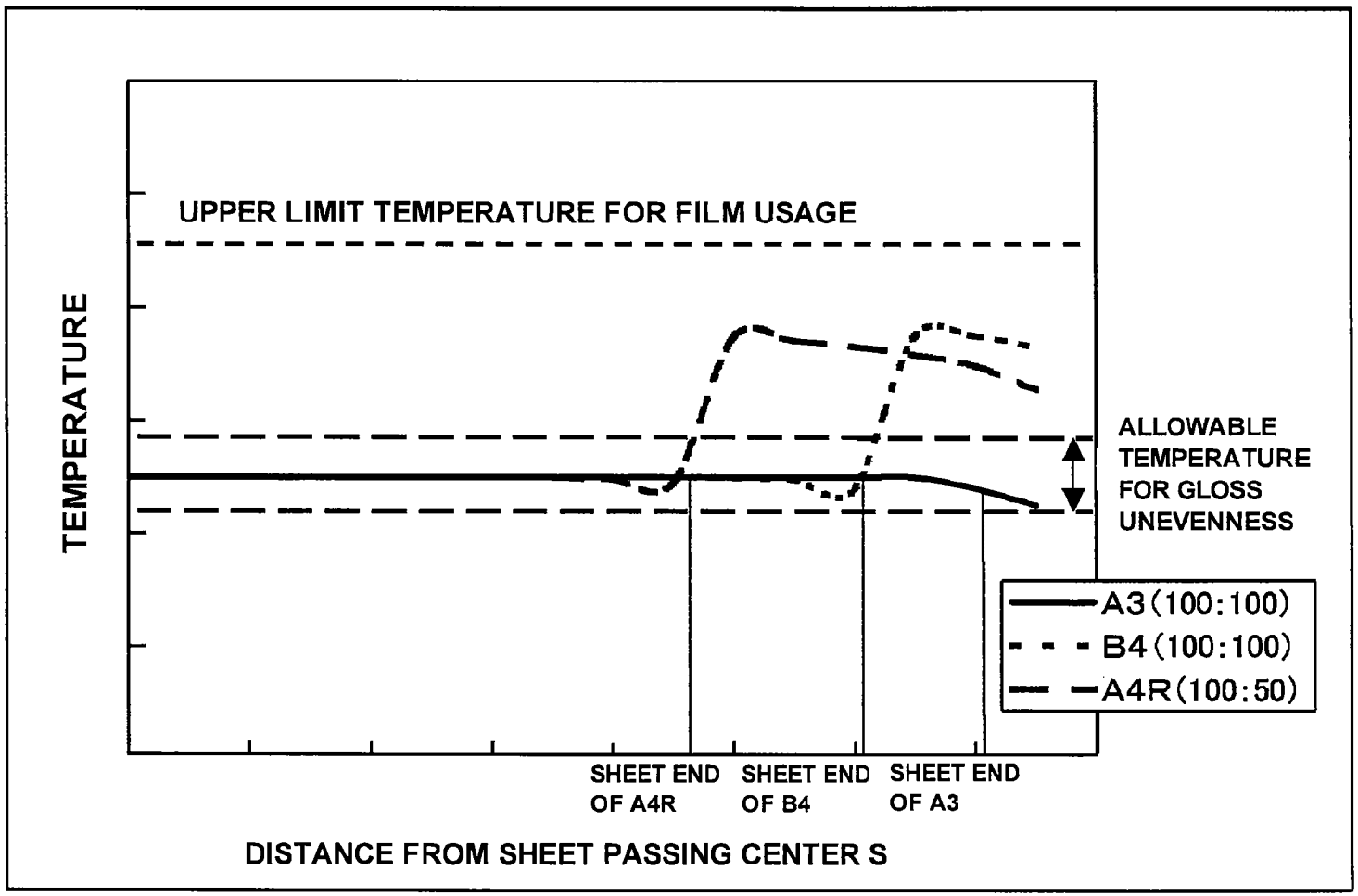
FIG. 23 is a graph which illustrates the film temperature distribution after the cooling operation according to the second embodiment.

Being the same as the first embodiment, the powering ratio is switched to the setting for after starting cooling in Table 1 when the cooling operation is started. FIG. 23 illustrates the temperature distribution of the film surface just before the fan driving stops in the second embodiment. From the comparison between FIG. 15 and FIG. 22 and the comparison between FIG. 16 and FIG. 23, unevenness in the temperature in the sheet passing area is further decreased against the first embodiment.

In the first embodiment and the second embodiment, the fan 41 is configured to cool the fixing member. However, the similar effects can be obtained with the configuration to cool the pressure member. Further, the apparatus is not limited to the heating apparatus of the film heating method in the above embodiments, the heating apparatuses of the heat roller method and other configurations can be utilized for the fixing mechanism portion 20A. Further, the fixing mechanism portion 20A can also utilize the electromagnetic induction heating method. Furthermore, similar effects can be obtained with the fixing mechanism portion 20A which is configured to perform the sheet passing of the recording material by the side-based conveyance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-137657, filed May 27, 2008, which is hereby incorporated by reference herein in its entirety.

What is claimed is:

1. An image heating apparatus, comprising:

a heating member which heats a toner image on a recording material at a nip portion;

a first heater and a second heater which heat the heating member, the generating heat amount of the first heater being larger at the center part in the longitudinal direction than at the end part thereof and the generating heat amount of the second heater being larger at the end part in the longitudinal direction than at the center part thereof;

changing means for changing the ratio of power supplied to the second heater to power supplied to the first heater in accordance with length in the longitudinal direction of the recording material which is heated by the heating member;

temperature detecting means for detecting the temperature at the end part of the heating member; and a fan which performs air blowing to cool the end part of the heating member in accordance with the temperature detected by the temperature detecting means, wherein the changing means changes the ratio when the fan starts air blowing.

2. The image heating apparatus according to claim 1, wherein the changing means changes the ratio so that the ratio with a first recording material whose length in the longitudinal direction is shorter than a second recording material is to be smaller than the ratio with the second recording material whose length in the longitudinal direction is longer than the first recording material.

3. The image heating apparatus according to claim 2, wherein the fan starts air blowing when the detecting temperature is raised to a predetermined temperature.

4. The image heating apparatus according to claim 3, further comprising:

a shutter which changes the area of the heating member receiving the blowing air blown by the fan; and adjusting means for adjusting the area by changing the position of the shutter in accordance with the length in the longitudinal direction of the recording material which is heated by the heating member.

* * * * *